US012540427B2

(12) United States Patent
Pan et al.

(10) Patent No.: US 12,540,427 B2
(45) Date of Patent: Feb. 3, 2026

(54) SPRING BED MESH SEWING DEVICE AND SPRING BED MESH SEWING METHOD

(71) Applicant: Guangzhou Lianrou Machinery &Equipment Co., Ltd, Guangzhou (CN)

(72) Inventors: Rongfeng Pan, Guangzhou (CN); Huagui Li, Guangzhou (CN); Zhiming Tan, Guangzhou (CN); Zhiliang Tan, Guangzhou (CN)

(73) Assignee: Guangzhou Lianrou Machinery & Equipment Co., Ltd, Guangzhou (CN)

( * ) Notice: Subject to any disclaimer, the term of this patent is extended or adjusted under 35 U.S.C. 154(b) by 0 days.

(21) Appl. No.: 18/761,885

(22) Filed: Jul. 2, 2024

(65) Prior Publication Data

US 2025/0129529 A1 Apr. 24, 2025

(30) Foreign Application Priority Data

Oct. 19, 2023 (CN) ..... 202311363473.3

(51) Int. Cl.
*D05B 11/00* (2006.01)
*D05B 25/00* (2006.01)
*D05B 29/00* (2006.01)

(52) U.S. Cl.
CPC ..... *D05B 11/00* (2013.01); *D05B 25/00* (2013.01); *D05B 29/00* (2013.01)

(58) Field of Classification Search
CPC ..... D05B 11/005; D05B 11/00; D05B 13/00; D05B 13/02; D05B 29/00
See application file for complete search history.

(56) References Cited

U.S. PATENT DOCUMENTS 1,733,660 A * 10/1929 Gail ..... B21F 33/04 112/470.27
1,813,993 A * 7/1931 Gail ..... B21F 33/04 53/550
5,868,383 A * 2/1999 Codos ..... F16F 3/04 5/655.8
6,256,820 B1 * 7/2001 Moser ..... A47C 27/064 5/721

(Continued)

FOREIGN PATENT DOCUMENTS

CN 221028975 U * 5/2024

*Primary Examiner* — Danny Worrell
(74) *Attorney, Agent, or Firm* — Myers Wolin, LLC

(57) ABSTRACT

A spring bed mesh sewing device includes a feeding assembly, sewing assemblies, and cloth pressing assemblies. The feeding assembly can lay spring strings in the transverse direction. Each of the spring strings to be sewn in even rows is sewn on a respective previous spring string through the first sewing positions, each of the spring strings to be sewn in odd rows is sewn on a respective previous spring string through the second sewing positions. The sewing assemblies are arranged at intervals in the transverse direction and are movable in the vertical direction. Each sewing assembly includes a sewing head and a base with a sewing channel extending in the vertical direction. The sewing head can sew two adjacent rows of spring strings along the sewing channel. The cloth pressing assemblies are arranged at intervals in the transverse direction and correspond to the sewing assemblies in the longitudinal direction.

19 Claims, 14 Drawing Sheets

(56) References Cited

U.S. PATENT DOCUMENTS

| | | | | |
|---|---|---|---|---|
| 6,260,331 | B1 * | 7/2001 | Stumpf | B29C 66/232 53/436 |
| 6,347,423 | B1 * | 2/2002 | Stumpf | A47C 27/064 5/655.9 |
| 9,332,856 | B2 * | 5/2016 | Eigenmann | A47C 27/064 |
| 10,905,246 | B2 * | 2/2021 | Thomas | A47C 27/062 |
| 11,633,048 | B2 * | 4/2023 | Grothaus | B68G 9/00 5/720 |
| 11,834,324 | B2 * | 12/2023 | Liang | B68G 9/00 |
| 2009/0222985 | A1 * | 9/2009 | Richmond | A47C 27/064 5/247 |
| 2020/0198961 | A1 * | 6/2020 | Tan | A47C 27/063 |
| 2023/0346131 | A1 * | 11/2023 | Tan | B68G 9/00 |
| 2024/0157466 | A1 * | 5/2024 | Liang | B23K 20/10 |
| 2025/0129529 | A1 * | 4/2025 | Pan | D05B 25/00 |

* cited by examiner

A

SPRING BED MESH SEWING DEVICE AND SPRING BED MESH SEWING METHOD

CROSS-REFERENCE TO RELATED APPLICATION

This application is based on and claims the benefit of priority from Chinese Patent Application No. 202311363473.3, filed on 19 Oct. 2023, which are incorporated by reference herein in their entirety.

TECHNICAL FIELD

The present disclosure relates to the field of spring bed mesh production, and in particular, to a spring bed mesh sewing device and a spring bed mesh sewing method.

BACKGROUND

Independent bagged spring bed mesh is usually manufactured by combining a plurality of rows of spring strings in parallel. Existing bed mesh combination device mainly has two combination modes: glue bonding and ultrasonic welding. The disadvantages of glue bonding lie in large amount of hot melt adhesive, high cost, and non-environmental protection. Ultrasonic welding can improve the environmental protection level for the spring bed mesh, but has the disadvantage that it is only suitable for fusible materials, such as nonwoven fabrics made of polyester or polyester fibers.

In the related art, there is already automated equipment that can produce spring strings made of natural fiber (cotton, wool, silk, linen, etc.) fabrics by sewing. However, the material of this type of fabric cannot be welded using ultrasonic, necessitating the use of adhesive to bond various spring strings. This, in turn, reduces the environmental protection level for the spring bed mesh. Although it is possible to manufacture the bed mesh by manual stitching, this method is characterized by low production efficiency, high production costs, and inconsistent product quality.

SUMMARY

The present disclosure aims to solve at least one of the technical problems in the existing technology. To this end, the present disclosure provides a spring bed mesh sewing device and a spring bed mesh sewing method. The spring bed mesh sewing device can sew spring strings into a spring bed mesh. The spring bed mesh sewing device eliminates the need to use hot melt adhesive when assembling spring strings, helping to manufacture adhesive-free spring bed mesh made of natural fibers. The spring bed mesh sewing device also helps to improve the degree of automation and the product quality of sewing type spring bed meshes.

The spring bed mesh sewing device provided according to the present disclosure includes a feeding assembly, sewing assemblies and cloth pressing assemblies. The feeding assembly is movable in a transverse direction, so as to lay spring strings along the transverse direction, connecting parts of the spring strings in two adjacent rows are defined as sewing positions that include first sewing positions and second sewing positions, each of the spring strings to be sewn in even rows is sewn on a respective previous spring string through the first sewing positions, and each of the spring strings to be sewn in odd rows is sewn on a respective previous spring string through the second sewing positions. The sewing assemblies are arranged at intervals in the transverse direction and correspond to the sewing positions, wherein the sewing assemblies are movable in a vertical direction so as to be pulled out from the spring strings and switched to the spring strings in a next row, each of the sewing assemblies includes a sewing head and a base, the base is formed with a sewing channel extending in the vertical direction, the sewing head is installed on the base and includes a needle and a needle plate that are arranged oppositely in the longitudinal direction, and the sewing head is movable along the sewing channel to sew the spring strings in two adjacent rows. The cloth pressing assemblies are arranged at intervals in the transverse direction, wherein the cloth pressing assemblies correspond to the sewing assemblies in the longitudinal direction and are configured to press the sewing positions to be sewn on the base, so as to cooperate with the sewing head for sewing.

The spring bed mesh sewing device provided by the present disclosure has at least the following technical effects. The spring bed mesh sewing device uses the sewing assemblies to sew spring strings into a spring bed mesh. The feeding assembly lays out the spring string in each row in sequence, and starting from the spring string in the second row, after the spring string in each row is laid, the cloth pressing assemblies press the sewing positions to be sewn on the bases, and the sewing assemblies alternately sew the first sewing positions and the second sewing positions. The spring bed mesh sewing device eliminates the need to use hot melt adhesive when assembling the spring strings, helping to manufacture adhesive-free spring bed meshes made of natural fibers. The feeding assembly can automatically feed the material, and the sewing assemblies perform sewing after a row of spring string is laid, which improves the production efficiency of spring bed meshes, and improves the automation degree and product quality of sewing type spring bed meshes.

According to some embodiments of the present disclosure, the sewing assemblies are movable in the longitudinal direction, so as to push the sewn spring strings to move downstream.

According to some embodiments of the present disclosure, the sewing assemblies are movable in the transverse direction, so as to correspond to the first sewing positions or the second sewing positions, respectively.

According to some embodiments of the present disclosure, the plurality of sewing assemblies are divided into two groups, the sewing assemblies of the same group are arranged at intervals in the transverse direction, the sewing assemblies of different groups are interlaced with each other in the transverse direction, the two groups of sewing assemblies correspond to the first sewing positions and the second sewing positions respectively, and the sewing assemblies are movable in the longitudinal direction, so that the two groups of sewing assemblies alternately push the spring strings and perform sewing actions.

According to some embodiments of the present disclosure, the spring bed mesh sewing device further includes two first installation assemblies, wherein the two groups of sewing assemblies are installed on the two first installation assemblies respectively, and are arranged on opposite sides of the spring strings in the vertical direction respectively.

According to some embodiments of the present disclosure, each of the first installation assemblies includes a first installation base, a second installation base, a first guide member, and a second guide member, the first guide member is installed on a frame and extends along the vertical direction, the first installation base is movably installed on the first guide member, the second guide member is installed on the first installation base and extends along the longitudinal direction, and the second installation base is movably installed on the second guide member.

According to some embodiments of the present disclosure, a spacing between adjacent sewing assemblies is adjustable, so as to match the spring strings of different specifications, each of the first installation assemblies includes a third guide member extending in the transverse direction, the third guide member is installed on the second installation base, and each of the sewing assemblies is movably installed on the third guide member.

According to some embodiments of the present disclosure, wherein each of the cloth pressing assemblies includes two first pressing plates arranged at an interval in the transverse direction, an avoidance channel for avoiding the sewing head is formed between the first pressing plates, each of the cloth pressing assemblies includes a fourth driver, the first pressing plates are installed on the fourth driver, and the fourth driver is configured to drive the first pressing plates to move in the longitudinal direction.

According to some embodiments of the present disclosure, the cloth pressing assemblies are movable in the vertical direction, or the cloth pressing assemblies is rotatable around an axis along the transverse direction, so as to avoid a movement path of the feeding assembly; the spring bed mesh sewing device includes a second installation assembly including a fourth installation base and a fifth driver, the fourth installation base is rotatably installed on the frame, the cloth pressing assemblies are installed on the fourth installation base, and the fifth driver is configured to drive the fourth installation base and the cloth pressing assemblies to rotate.

According to some embodiments of the present disclosure, a spacing between adjacent cloth pressing assemblies is adjustable, so as to match the spring strings of different specifications, the second installation assembly includes a fourth guide member extending in the transverse direction, and the cloth pressing assemblies are movably installed on the fourth guide member.

According to some embodiments of the present disclosure, the spring bed mesh sewing device further includes two limit assemblies arranged at an interval in the vertical direction, so as to form a material receiving channel for limiting the spring strings, wherein the base extends in the vertical direction and across the material receiving channel, and the feeding assembly lays the spring strings on the base located in the material receiving channel.

According to some embodiments of the present disclosure, each of the limit assemblies includes limit bars, the limit bars of the same group are arranged at intervals in the transverse direction, the limit bars are staggered from the sewing assemblies in the transverse direction, so as to allow the sewing assemblies to pass between the limit bars, the limit bars are provided with magnets for attracting and positioning the spring strings, each of the limit assemblies includes a fifth guide member extending in the transverse direction, and each of the limit bars is movably installed on the respective fifth guide member, so as to adjust an spacing between the limit bars in the transverse direction.

According to some embodiments of the present disclosure, the spring bed mesh sewing device further includes a receiving assembly, wherein the receiving assembly is located on a side of the limit assemblies away from the feeding assembly, and the receiving assembly includes a receiving platform for receiving a spring bed mesh.

According to some embodiments of the present disclosure, the spring bed mesh sewing device further includes a cutting assembly, wherein the cutting assembly is located on one side or both sides of the sewing assemblies in the transverse direction, the cutting assembly includes a second pressing plate, a third pressing plate and a cutter, the second pressing plate and the third pressing plate are arranged oppositely in the longitudinal direction and are movable toward each other to compress the spring strings, and the cutter is movable in the vertical direction to cut the spring strings.

According to some embodiments of the present disclosure, the feeding assembly includes a conveying member, and the conveying member includes at least one of ratchets, rollers and a conveying belt, and is configured to convey the spring strings.

According to some embodiments of the present disclosure, the feeding assembly is formed with a conveying channel, the conveying member is located at an outlet of the conveying channel and includes two ratchets arranged oppositely in the transverse direction, rolling elements are arranged on an inner wall of the conveying channel, and the rolling elements are configured to reduce a conveying resistance of the spring strings.

A spring bed mesh sewing method, using the spring bed mesh sewing device according to claim 1, includes: S100: moving the sewing assemblies to correspond to the first sewing positions; S200: moving the feeding assembly along the transverse direction to lay the spring string in a first row; S300: moving the feeding assembly along the transverse direction to lay the spring string in an even row on the spring string in an odd row; S400: pressing by the cloth pressing assemblies the first sewing positions of the spring string in the even row and the spring string in the odd row on the bases, and moving the sewing heads along the vertical direction to sew the first sewing positions; S500: pulling the sewing assemblies out from the spring strings, and releasing compression by the cloth pressing assemblies; S600: moving the sewing assemblies to correspond to the second sewing positions; S700: moving the feeding assembly along the transverse direction to lay the spring string in a further odd row on the spring string in the even row; S800: pressing by the cloth pressing assemblies the second sewing positions of the spring string in the even row and the spring string in the further odd row on the bases, and moving the sewing heads along the vertical direction to sew the second sewing positions; S900: pulling the sewing assemblies out from the spring strings, and releasing compression by the cloth pressing assemblies; S1000: moving the sewing assemblies to correspond to the first sewing positions; and repeating S300 to S1000 until the spring strings are sewn into a spring bed mesh of a predetermined size.

According to some embodiments of the present disclosure, in S1000, the sewing assemblies move along the transverse direction and switch to correspond to the first sewing positions, and in S600, the sewing assemblies move along the transverse direction and switch to correspond to the second sewing positions.

A spring bed mesh sewing method, using the spring bed mesh sewing device according to claim 4, includes: S100: moving a first group of sewing assemblies to be in sewing stations; S200: moving the feeding assembly along the transverse direction to lay the spring string in a first row; S300: moving a second group of sewing assemblies to a side of the spring strings in an odd row close to the feeding assembly, and moving the second group of the sewing assemblies along the longitudinal direction to push the spring string in the odd row to the sewing stations; S400: moving the feeding assembly along the transverse direction to lay the spring string in an even row on the spring string in the odd row; S500: pressing by the cloth pressing assemblies the first sewing positions of the spring string in the even row and the spring string in the odd row on the bases of the first group of sewing assemblies, and moving the sewing heads of the first group of sewing assemblies along the vertical direction to sew the first sewing positions; S600: pulling the first group of sewing assemblies out from the spring strings, and releasing compression by the cloth pressing assemblies; S700: moving the first group of sewing assemblies to a side of the spring string in the even row close to the feeding assembly, and move the first group of sewing assemblies along the longitudinal direction to push the spring string in the even row to the sewing stations; S800: moving the feeding assembly along the transverse direction to lay the spring string in a further odd row on the spring string in the even row; S900: pressing by the cloth pressing assemblies the second sewing positions of the spring string in the even row and the spring string in the further odd row on the bases of the second group of sewing assemblies, and moving the sewing heads of the second group of sewing assemblies along the vertical direction to sew the second sewing positions; S1000: pulling the second group of sewing assemblies out from the spring strings, and releasing compression by the cloth pressing assemblies; and repeating S300 to S1000 until the spring strings are sewn into a spring bed mesh of a predetermined size.

The spring bed mesh sewing methods provided by the present disclosure use the spring bed mesh sewing device provided by the present disclosure, and therefore have the beneficial effects produced by the spring bed mesh sewing device, which will not be described again here.

BRIEF DESCRIPTION OF DRAWINGS

The above and/or additional aspects and advantages of the present disclosure will become apparent and readily understood from the description of the embodiments in conjunction with the following accompanying drawings, in which.

Figure 1:
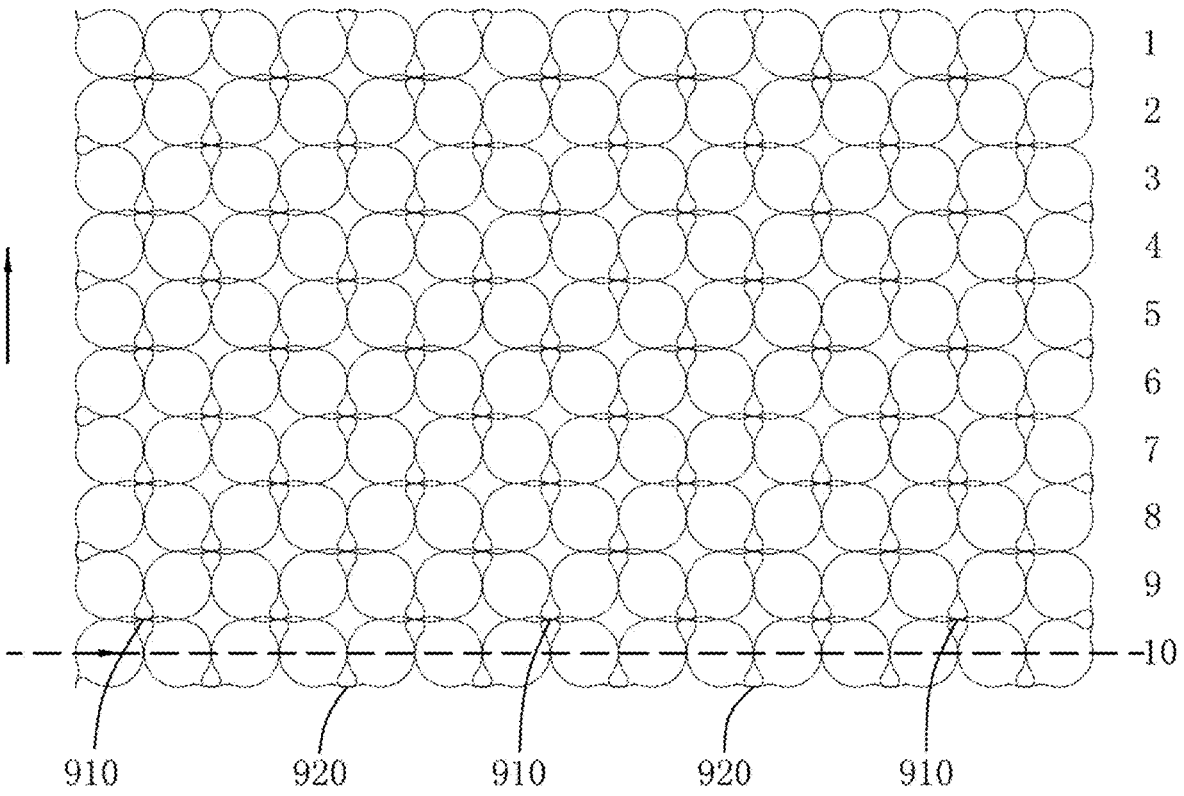
FIG. 1 is a schematic structural diagram of a spring bed mesh sewn by a spring bed mesh sewing device according to an embodiment of the present disclosure.

REFERENCE NUMERALS feeding assembly 100, conveying member 110, rolling element 120, sewing assembly 200, sewing head 210, needle 211, needle plate 212, base 220, third driver 230, cloth pressing assembly 300, first pressing plate 310, fourth driver 320, bottom plate 330, limit assembly 400, limit bar 410, connecting plate 420, fifth guide member 430, receiving table 510, cutting assembly 600, second pressing plate 610, third pressing plate 620, cutter 630, fifth installation base 640, sixth driver 650, seventh driver 660, sixth guide member 670, first installation base 711, second installation base 712, first guide member 713, second guide member 714, fixing base 716, second driver 717, fifth installation base 718, third installation base 721, fourth installation base 722, fourth guide member 723, fifth driver 724, spring string 900, first sewing position 910, second sewing position 920.

DETAILED DESCRIPTION

The embodiments of the present disclosure are described in detail below. Examples of the embodiments are shown in the accompanying drawings, where the same or similar reference numerals throughout represent the same or similar elements or elements with the same or similar functions. The embodiments described below with reference to the accompanying drawings are exemplary and are only used to explain the present disclosure, and cannot be understood as limiting the present disclosure.

In the description of the present disclosure, it is to be understood that, referring to orientation description, the indicated orientation or positional relationships, for example, "center", "transverse", "longitudinal", "length", "width", "thickness", "up", "down", "front", "back", "left", "right", "vertical", "horizontal", "top", "bottom", "inner", "outer", "axial", "radial", "circumferential", etc. are based on the orientation or positional relationships shown in the accompanying drawings, merely for ease of description of the present disclosure and simplification for the description, rather than indicating or implying that the device or element referred to must have a specific orientation and be constructed and operated in a specific orientation, which, therefore, cannot be construed as limiting the present disclosure.

In the description of the present disclosure, several refers to one or more, a plurality of refers to two or more, greater than, less than, over and the like are understood not to include the specified number, and above, below, within and the like are understood to include the specified number. If described, first and second are only for the purpose of distinguishing technical features, and not to be construed as indicating or implying relative importance, or implicitly indicating the number of technical features indicated, or implicitly indicating the precedence relationship of technical features indicated.

In the description of the present disclosure, unless explicitly defined otherwise, the terms such as "arrangement", "installation", "connection" should be understood in a broad sense, and those of ordinary skill in the art can reasonably determine the specific meaning of the above terms in the present disclosure combined with the specific content of the technical solution.

A spring bed mesh is composed of spring strings in a plurality of rows. Springs are encapsulated in fabric to form a spring string, which includes a plurality of bagged springs connected in sequence. The existing spring bed mesh usually requires the use of hot melt adhesive when assembling, which results in the production process of the spring bed mesh being highly polluting, and the finished products being not environmentally friendly enough, making it difficult to meet the requirements of low-carbon and environmentally friendly production. Although the use of welding technology to combine a spring bed mesh can reduce the use of hot melt adhesive, the range of fabrics suitable for the welding technology is small and the usage scenarios are limited.

In the related art, a device for packaging and manufacturing spring strings using a sewing process has emerged. However, there is still a lack of corresponding automated device in the process of combining spring strings into spring bed mesh.

Figure 2:
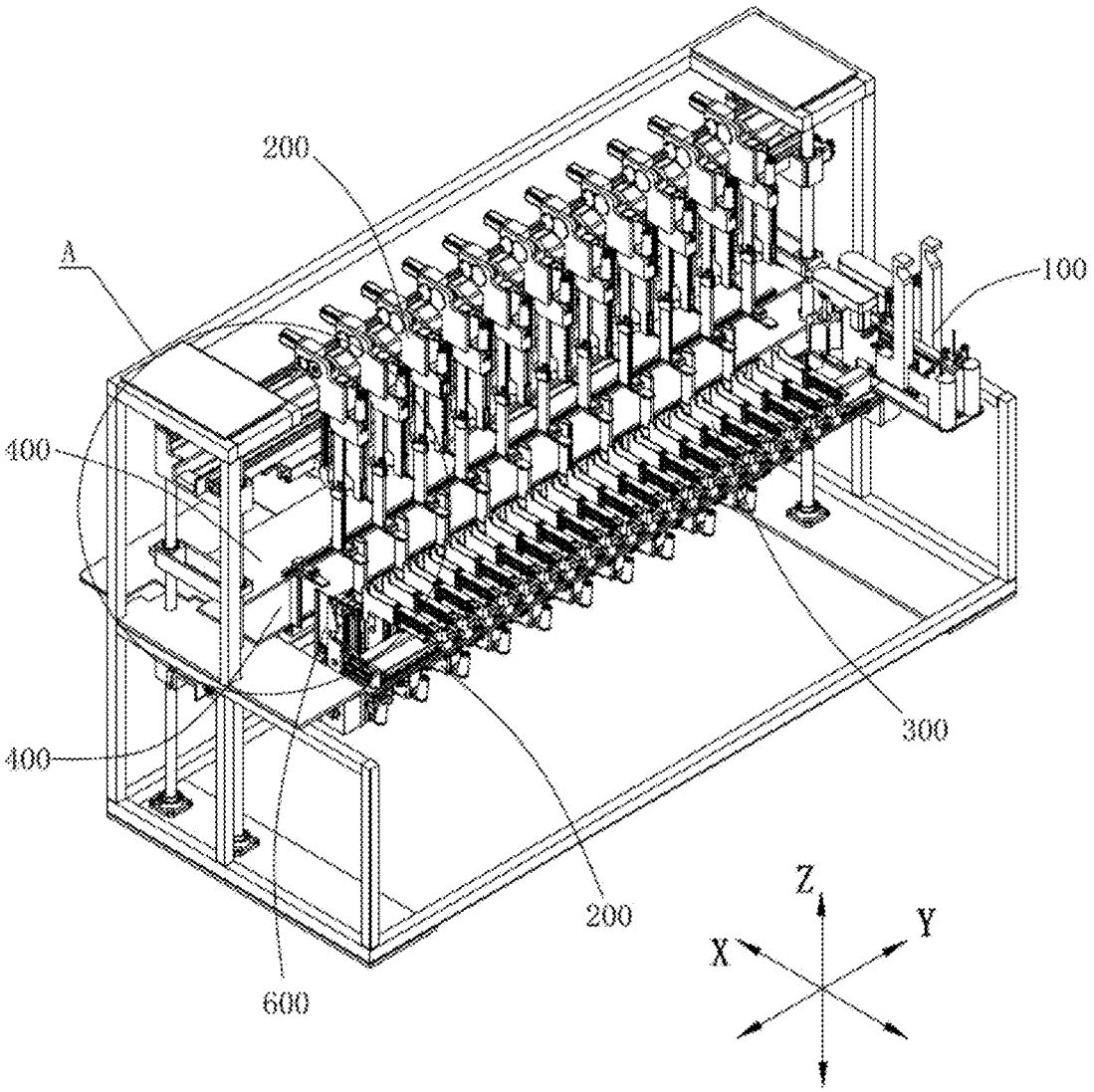
FIG. 2 is a schematic diagram of the overall structure of the spring bed mesh sewing device according to an embodiment of the present disclosure.
Figure 3:
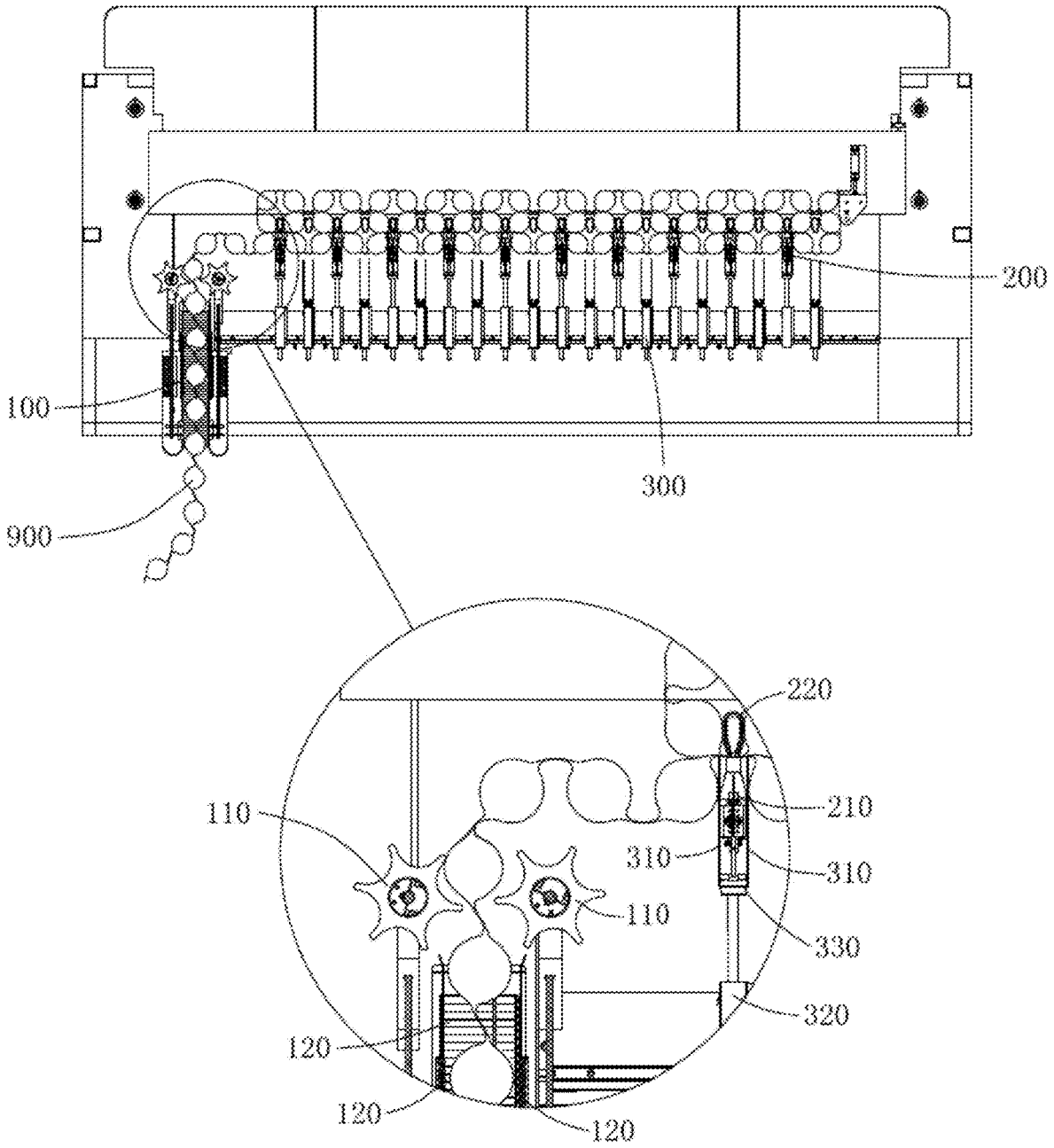
FIG. 3 is a top view of the spring bed mesh sewing device according to an embodiment of the present disclosure when performing sewing.

Referring to FIGS. 1, 2 and 3, the spring bed mesh sewing device provided according to the present disclosure includes a feeding assembly 100, sewing assemblies 200 and cloth pressing assemblies 300. The feeding assembly 100 can move in a transverse direction (that is, Y direction in FIG. 2, the left-right direction), so as to lay spring strings 900 along the transverse direction. Connecting parts of the spring strings 900 in two adjacent rows are defined as sewing positions which include first sewing positions 910 and second sewing positions 920. each of the spring strings 900 to be sewn in even rows is sewn on a respective previous spring string 900 through the first sewing positions 910, and each of the spring strings 900 to be sewn in odd rows is sewn on a respective previous spring string 900 through the second sewing positions 920.

Figure 4:
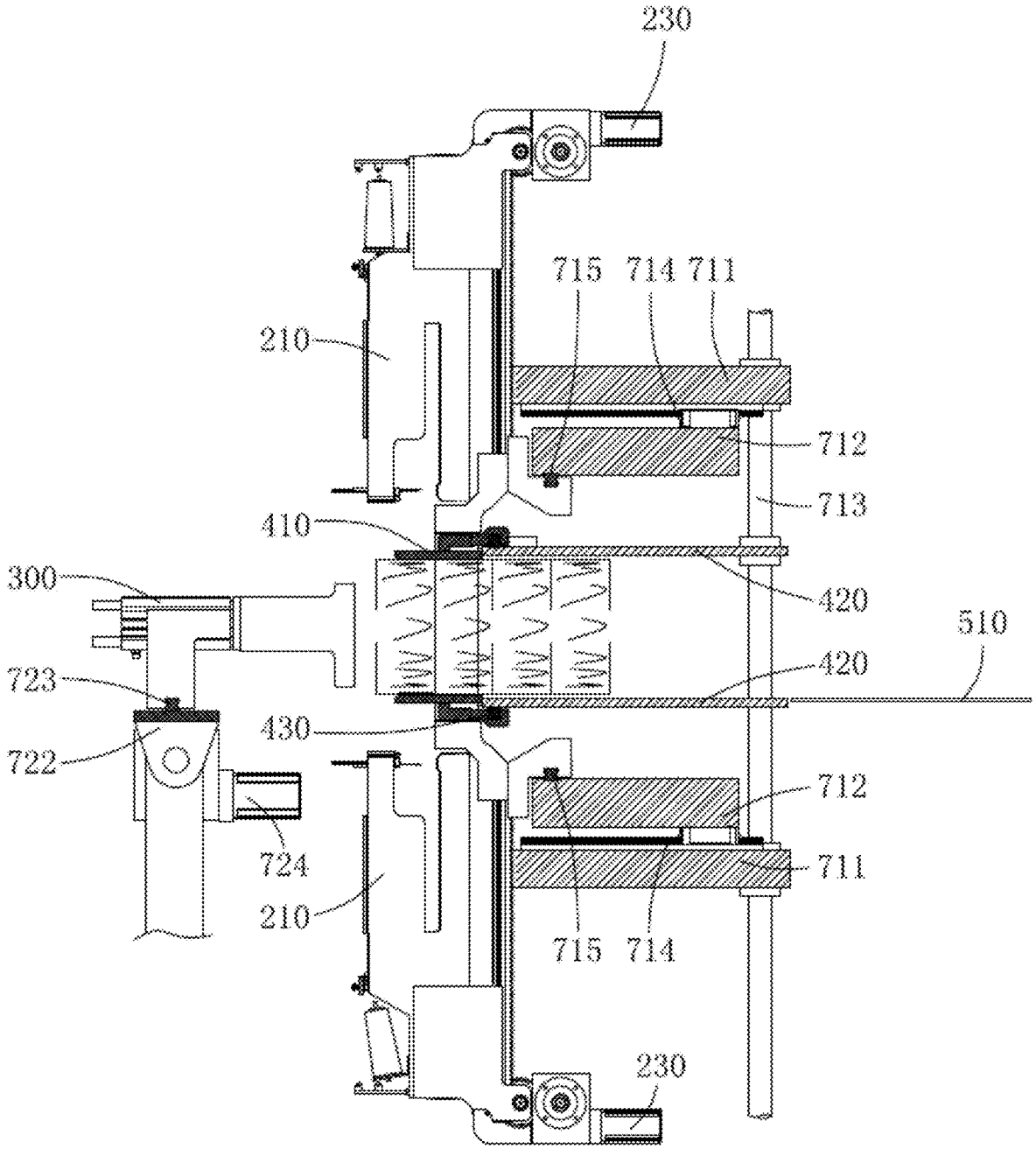
FIG. 4 is a side sectional view of the spring bed mesh sewing device according to an embodiment of the present disclosure when performing sewing.

Referring to FIG. 4, the multiple sewing assemblies 200 are arranged at intervals in the transverse direction and correspond to the sewing positions, and the sewing assemblies 200 can move in a vertical direction (that is, Z direction in FIG. 2, the up-down direction), so as to be pulled out from the spring strings 900 and switched to the spring strings 900 in the next row.

Figure 5:
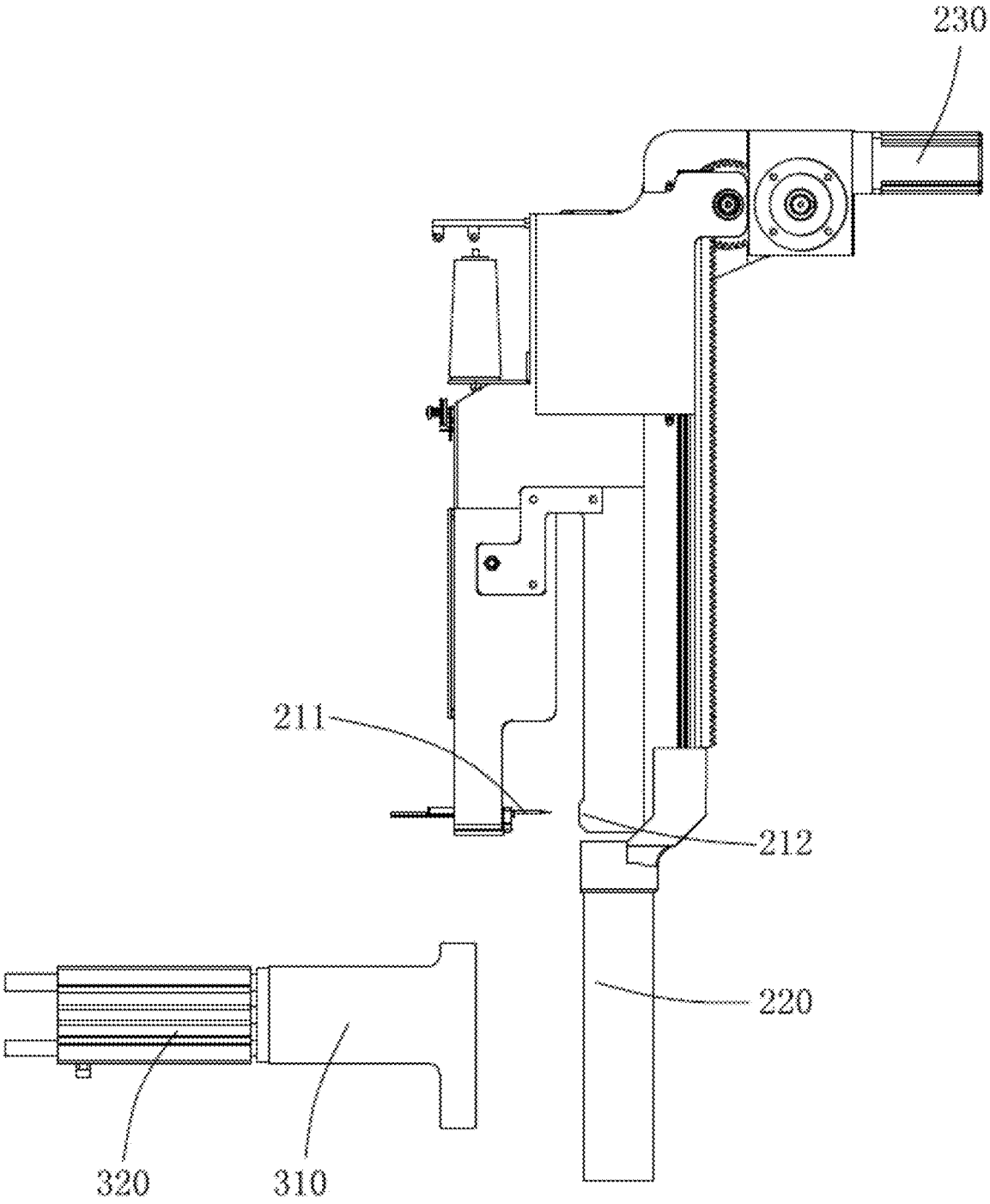
FIG. 5 is a side view of sewing assemblies and cloth pressing assemblies according to an embodiment of the present disclosure.
Figure 6:
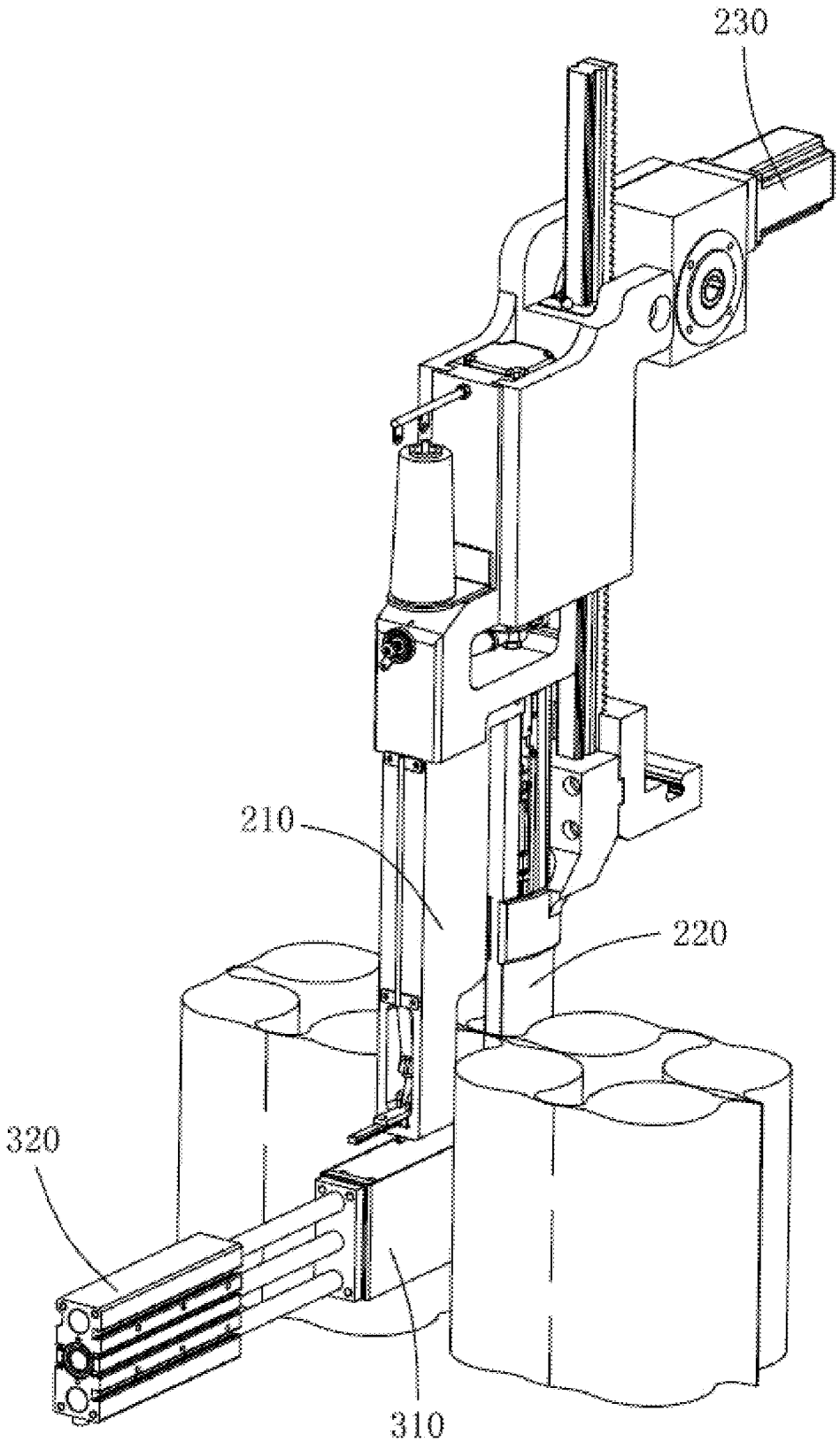
FIG. 6 is a schematic diagram of a partial structure of the sewing assemblies and the cloth pressing assemblies cooperating for sewing according to an embodiment of the present disclosure.

Referring to FIGS. 4, 5 and 6, each sewing assembly 200 includes a sewing head 210 and a base 220. The sewing head 210 is installed on the base 220 and includes a needle 211 and a needle plate 212 which are arranged oppositely in the longitudinal direction. The base 220 is formed with a sewing channel extending in the vertical direction. The sewing head 210 can move along the sewing channel to sew the spring strings 900 in two adjacent rows. A plurality of cloth pressing assemblies 300 are arranged at intervals in the transverse direction. The cloth pressing assemblies 300 correspond to the sewing assemblies 200 in the longitudinal direction and are used to press the sewing positions to be sewn (that is, the first sewing positions 910 or the second sewing positions 920) on the base 220, so as to cooperate with the sewing heads 210 for sewing.

FIG. 1 exemplarily shows a sewn spring bed mesh, and identifies the laying and sewing order of the spring bed mesh in ascending numerical order. As shown in FIG. 1, the spring string 900 in the first row (that is, the spring string 900 identified as 1) is laid first. Next, the spring string 900 in the second row (that is, the spring string 900 to be sewn) is laid on the spring string 900 in the first row, and is sewn on the spring string 900 in the first row through the first sewing positions 910 (obviously, the first row is an odd row). Then, the spring string 900 in the third row (that is, the new spring string 900 to be sewn) is laid on the spring string 900 in the second row, and is sewn on the spring string 900 in the second row through the second sewing positions 920 (obviously, the second row is an even row). Sewing is performed row by row according to this rule until the spring bed mesh is completed.

It can be understood that the feeding assembly 100 lays spring strings 900 in various rows in sequence, and the spring strings 900 in various rows can be connected together. At this time, the spring strings 900 fed by the feeding assembly 100 are continuous spring strings 900. The feeding assembly 100 is configured to lay the spring strings 900 in odd rows and even rows respectively during forward and reverse movements in the transverse direction. Alternatively, the spring strings 900 in respective rows can be disconnected before assembly. At this time, the spring strings 900 fed by the feeding assembly 100 are disconnected spring strings 900. The feeding assembly 100 can be configured to not only lay the spring strings 900 in odd rows and even rows respectively during forward and reverse movements in the transverse direction but also lay the spring strings 900 only during the forward movement. Starting from the spring string 900 in the second row, each time the spring string 900 in a row is laid, the cloth pressing assemblies 300 press the sewing positions to be sewn on the bases 220, and the sewing assemblies 200 alternately sew the first sewing positions 910 and the second sewing positions 920.

The present disclosure further provides a spring bed mesh sewing method, including the following steps:

- S100: the sewing assemblies 200 move to correspond to the first sewing positions 910;
- S200: the feeding assembly 100 moves along the transverse direction to lay the spring string 900 in the first row;
- S300: the feeding assembly 100 moves along the transverse direction to lay the spring string 900 in the even row (for example, the spring string 900 in the second row) on the spring string 900 in an odd row;
- S400: the cloth pressing assemblies 300 press the first sewing positions 910 of the spring string 900 in the even row and the spring string 900 in the odd row on the bases 220 of the sewing assemblies 200, and the sewing heads 210 of the sewing assemblies 200 move along the vertical direction to sew the first sewing positions 910;
- S500: the sewing assemblies 200 are pulled out from the spring strings 900, and the cloth pressing assemblies 300 are released from compression;
- S600: the sewing assemblies 200 move to correspond to the second sewing positions 920;
- S700: the feeding assembly 100 moves along the transverse direction to lay the spring string 900 in a further odd row on the spring string 900 in the even row;
- S800: the cloth pressing assemblies 300 press the second sewing positions 920 of the spring string 900 in the even row and the spring string 900 in the further odd row on the bases 220 of the sewing assemblies 200, and the sewing heads 210 of the sewing assemblies 200 move along the vertical direction to sew the second sewing positions 920;

S900: the sewing assemblies 200 are pulled out from the spring strings 900, and the cloth pressing assemblies 300 are released from compression;

S1000: the sewing assemblies 200 move to correspond to the first sewing positions 910; and S300 to S1000 are repeated until the spring strings 900 are sewn into a spring bed mesh of a predetermined size.

By using the sewing assemblies, the spring bed mesh sewing device provided by the present disclosure eliminates the need to use hot melt adhesive when assembling spring strings 900, helping to manufacture an adhesive-free spring bed mesh made of natural fibers and improve the environmental protection level of the spring bed mesh. The spring bed mesh sewing device realizes the automated production of sewing type spring bed meshes. The sewing assemblies 200 perform sewing after the spring string 900 in one row is laid, which improves the production efficiency of spring bed meshes and improves the product quality of sewing type spring bed meshes.

The spring bed mesh sewing method provided by the present disclosure uses the spring bed mesh sewing device, and therefore has the beneficial effects provided by the spring bed mesh sewing device, which will not be described again here.

The sewn spring strings 900 need to be transported downstream, so that the feeding assembly 100 can lay spring string 900 to be sewn in a new row. In other words, the spring strings 900 are sewn at the sewing stations of the spring bed mesh sewing device. When the sewing is completed, the sewn spring strings 900 need to be sent out of the sewing stations, and the spring string 900 to be sewn is sent to the sewing stations before a new sewing is started. To this end, in some embodiments, the sewing assemblies 200 can move in the longitudinal direction, so as to push the sewn spring strings 900 to move downstream.

The integration of the conveying function on the sewing assemblies 200 helps to simplify the structure of the spring bed mesh sewing device and the spring bed mesh sewing method. Certainly, the spring bed mesh sewing device may also be provided with a special conveying assembly to complete the longitudinal conveying of the sewn spring strings 900. For example, using a conveying belt as the conveying assembly, the feeding assembly 100 lays the spring strings 900 on the conveying belt. After sewing, the conveying belt is started to convey the spring strings 900 downstream. Alternatively, the conveying function may be integrated on the cloth pressing assemblies 300. After the sewing is completed, the cloth pressing assemblies 300 move in the longitudinal direction again to push out the spring strings 900.

During the sewing, the first sewing positions 910 and the second sewing positions 920 are sewn alternately. That is to say, the sewing assemblies 200 participating in sewing only need to correspond to the first sewing positions 910 or the second sewing positions 920 each time the sewing is performed. The spring bed mesh sewing device may have only one group of sewing assemblies 200, which switch to correspond to the first sewing positions 910 or the second sewing positions 920. Alternatively, the spring bed mesh sewing device has two groups of sewing assemblies 200, which correspond to the first sewing positions 910 and the second sewing positions 920, respectively.

Corresponding to the design concept of providing only one group of sewing assemblies 200, the spring bed mesh sewing device may be further designed as follows: the sewing assemblies 200 can move in the transverse direction, so as to correspond to the first sewing positions 910 or the second sewing positions 920, respectively.

In this case, exemplarily, S1000 in the spring bed mesh sewing method that the sewing assemblies 200 move to correspond to the first sewing positions 910 includes that the sewing assemblies 200 move along the transverse direction and switch to correspond to the first sewing positions 910; S600 that the sewing assemblies 200 move to correspond to the second sewing positions 920 includes that the sewing assemblies 200 move along the transverse direction and switch to correspond to the second sewing positions 920.

Further, when the sewing assemblies 200 can move in the longitudinal direction, in S500, before pulled out from the spring strings 900, the sewing assemblies 200 move along the longitudinal direction to push the sewn spring strings 900 away from the sewing stations. In S900, before the sewing assemblies 200 are pulled out from the spring strings 900, the sewing assemblies 200 move along the longitudinal direction to push the sewn spring strings 900 away from the sewing stations. In S200, the sewing assemblies 200 reach the sewing stations along the longitudinal direction, move in the transverse direction to positions corresponding to the first sewing positions 910, and are then inserted between the spring strings 900 along the vertical direction. In S600, the sewing assemblies 200 reach the sewing stations along the longitudinal direction, move along the transverse direction to correspond to the second sewing positions 920, and are then inserted between the spring strings 900 along the vertical direction.

Corresponding to the design concept of providing two groups of sewing assemblies 200, the sewing assemblies 200 do not need to move in the transverse direction, and only need to be re-inserted into new sewing positions after being pulled out.

In this case, the two groups of sewing assemblies 200 can move synchronously, and the corresponding spring bed mesh sewing method is basically the same as the spring bed mesh sewing method when there is only one group of sewing assemblies 200, except that the action of the sewing assemblies 200 moving in the transverse direction is omitted in steps 200 and 600.

However, in the above spring bed mesh sewing method, since the gap between the spring strings 900 is small, the sewing assemblies 200 can easily damage or even scratch the fabric when inserted, resulting in defective products. To this end, the two groups of sewing assemblies 200 can be designed to move alternately. Specifically, the spring bed mesh sewing device is further designed such that the plurality of sewing assemblies 200 are divided into two groups, and the sewing assemblies 200 of the same group are arranged at intervals in the transverse direction. The sewing assemblies 200 of difference groups are interlaced with each other in the transverse direction. The two groups of sewing assemblies 200 correspond to the first sewing positions 910 and the second sewing positions 920, respectively, and can respectively move in the longitudinal direction, so as to alternately move to the side of the spring strings close to the feeding assembly 100 and then return to the sewing positions, thereby avoiding damage to the spring strings when the sewing assemblies 200 are inserted into the sewing positions, and performing the sewing action alternately. The sewing assemblies 200 push the spring strings 900 to move downstream while returning to the sewing positions along the longitudinal direction.

Obviously, in the same group of sewing assemblies 200, the transverse distance between two adjacent bases 220 corresponds to the transverse size of two bagged springs.

Figure 7:
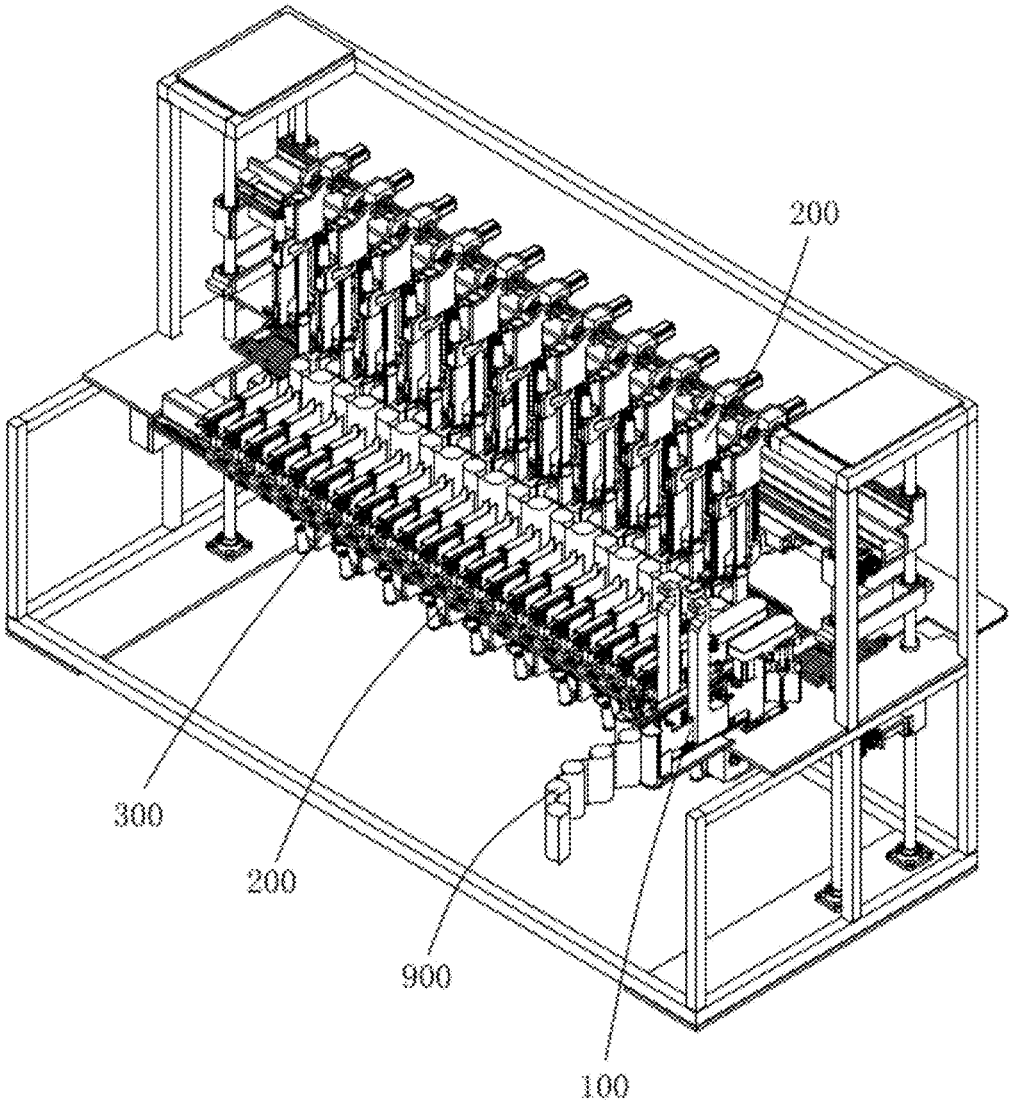
FIG. 7 is a schematic diagram of the operation of the spring bed mesh sewing device according to an embodiment of the present disclosure.
Figure 8:
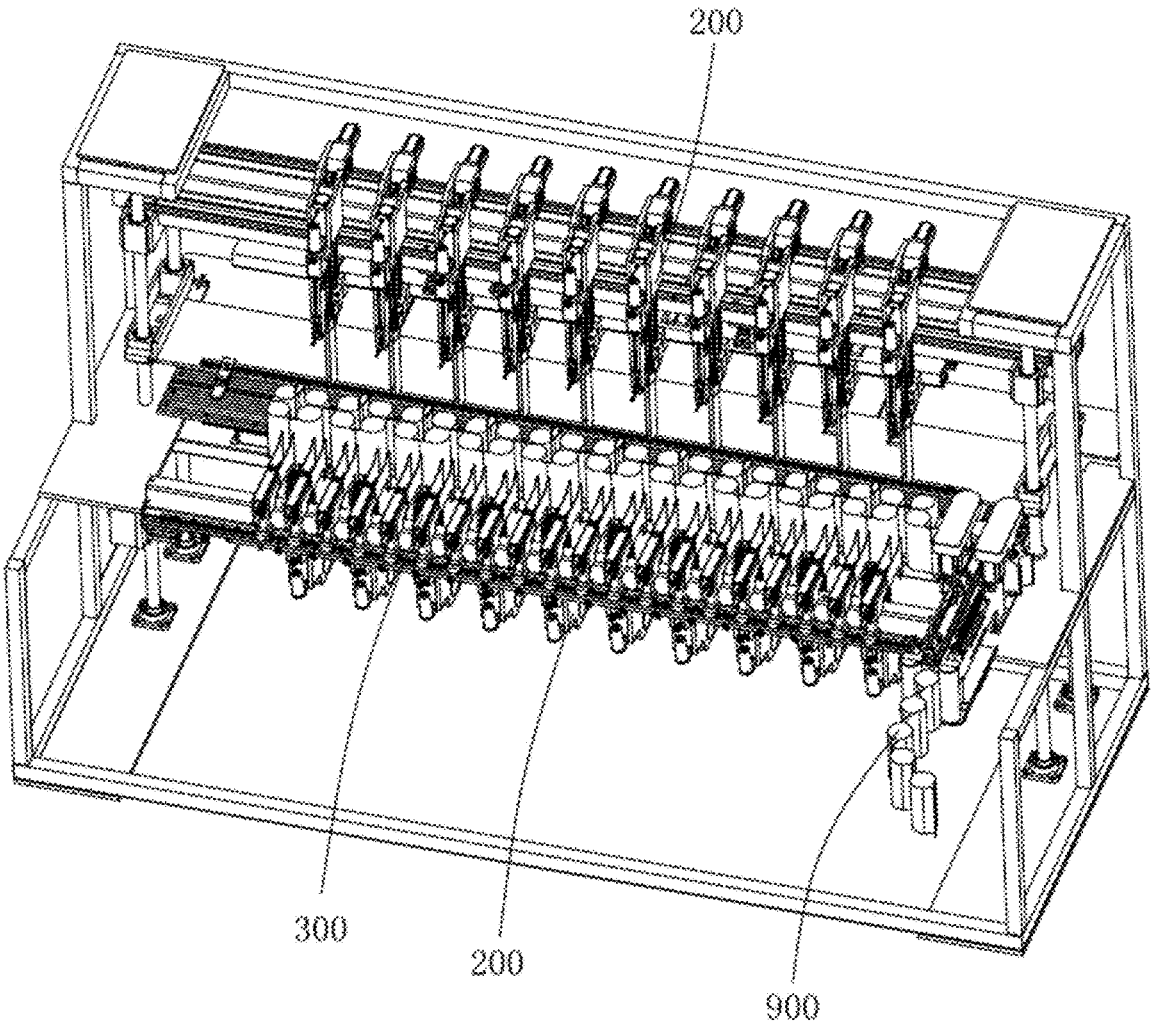
FIG. 8 is a schematic diagram of the operation of the spring bed mesh sewing device according to an embodiment of the present disclosure.
Figure 9:
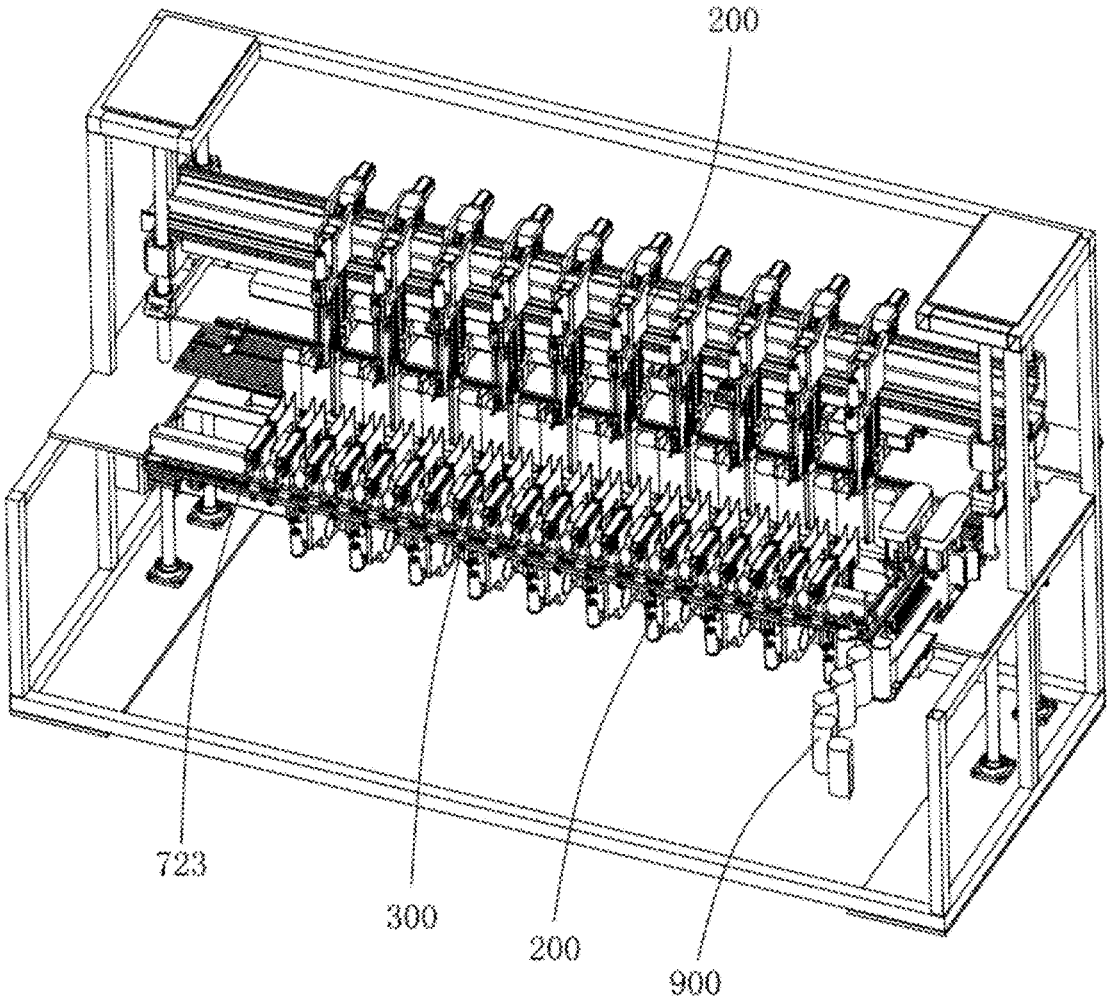
FIG. 9 is a schematic diagram of the operation of the spring bed mesh sewing device according to an embodiment of the present disclosure.
Figure 10:
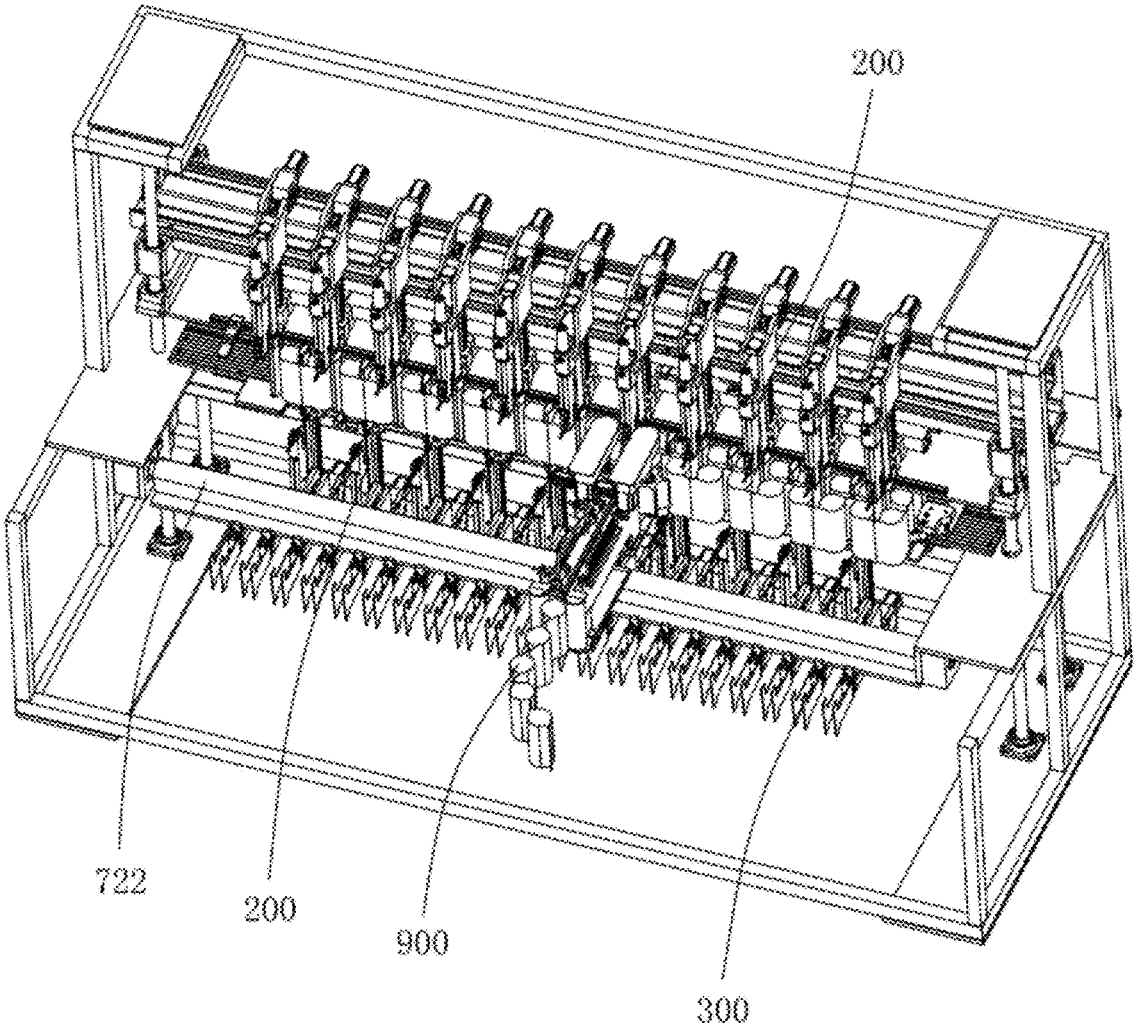
FIG. 10 is a schematic diagram of the operation of the spring bed mesh sewing device according to an embodiment of the present disclosure.

In this case, referring to FIGS. 3, 7, 8, 9 and 10, the spring bed mesh sewing method may include the following steps:

- S100: the first group of sewing assemblies 200 are in sewing stations;
- S200: the feeding assembly 100 moves along the transverse direction to lay the spring string 900 in the first row;
- S300: the second group of sewing assemblies 200 move to the side of the spring string 900 in an odd row (for example, the spring string 900 in the first row) close to the feeding assembly 100, and then move along the longitudinal direction to push the spring string 900 in the odd row to the sewing stations (starting from the third row, and the sewn spring strings 900 are also pushed away from the sewing stations at the same time);
- S400: the feeding assembly 100 moves along the transverse direction to lay the spring string 900 in an even row (for example, the spring string 900 in the second row) on the spring string 900 in the odd row;
- S500: the cloth pressing assemblies 300 press the first sewing positions 910 of the spring string 900 in the even row and the spring string 900 in the odd row on the bases 220 of the first group of sewing assemblies 200, and the sewing heads 210 of the first group of sewing assemblies 200 move along the vertical direction to sew the first sewing positions 910;
- S600: the first group of sewing assemblies 200 are pulled out from the spring strings 900 (as shown in FIG. 8), and the cloth pressing assemblies 300 are released from compression (as shown in FIG. 7);
- S700: the first group of sewing assemblies 200 move to the side of the spring string 900 in the even row close to the feeding assembly 100, and then move along the longitudinal direction to push the spring strings 900 in the even row to the sewing stations (as shown in FIG. 9, and the sewn spring strings 900 are also pushed away from the sewing stations at the same time);
- S800: the feeding assembly 100 moves along the transverse direction to lay the spring string 900 in a further odd row on the spring string 900 in the even row (as shown in FIG. 10);
- S900: the cloth pressing assemblies 300 press the second sewing positions 920 of the spring strings 900 in the even row and the spring string 900 in the further odd row on the bases 220 of the second group of sewing assemblies 200, and the sewing heads 210 of the second group of sewing assemblies 200 move along the vertical direction to sew the second sewing positions 920; and
- S1000: the second group of sewing assemblies 200 are pulled out from the spring strings 900, and the cloth pressing assemblies 300 are released from compression; and
- S300 to S1000 are repeated until the spring strings 900 are sewn into a spring bed mesh of a predetermined size.

In this method of alternately pushing the spring strings 900, since the sewing assemblies 200 are first inserted vertically and then move in the longitudinal direction into position, the risk of damage to the packaging bag (that is, the fabric of the spring strings 900) during the sewing process can be reduced.

It can be understood that the spring bed mesh sewing device needs to include first installation assemblies, and the two groups of sewing assemblies 200 are installed on the two first installation assemblies, respectively, so that the sewing assemblies 200 can move alternately with each other. Each first installation assembly includes a first driver and a second driver 717. The first driver is used to drive the respective sewing assembly 200 to move in the vertical direction, so that the sewing assembly 200 can be pulled out from between the spring strings 900. The second driver 717 is used to drive the respective sewing assembly 200 to move in the longitudinal direction, so as to approach the spring strings 900 laid by the feeding assembly 100 in the longitudinal direction, and push the spring strings 900 into position.

Exemplarily, referring to FIG. 4, in some embodiments, the two groups of sewing assemblies 200 are arranged on opposite sides of the spring strings 900 in the vertical direction, respectively. This layout enables adjacent sewing assemblies 200 to be staggered in the vertical direction, helps to reduce the distance between two adjacent sewing assemblies 200, and makes the spring bed mesh sewing device suitable for sewing the spring strings 900 having bagged springs with a smaller specification. Certainly, in other embodiments, the two groups of sewing assemblies 200 may also be arranged on the same side of the spring strings 900 in the vertical direction.

Figure 11:
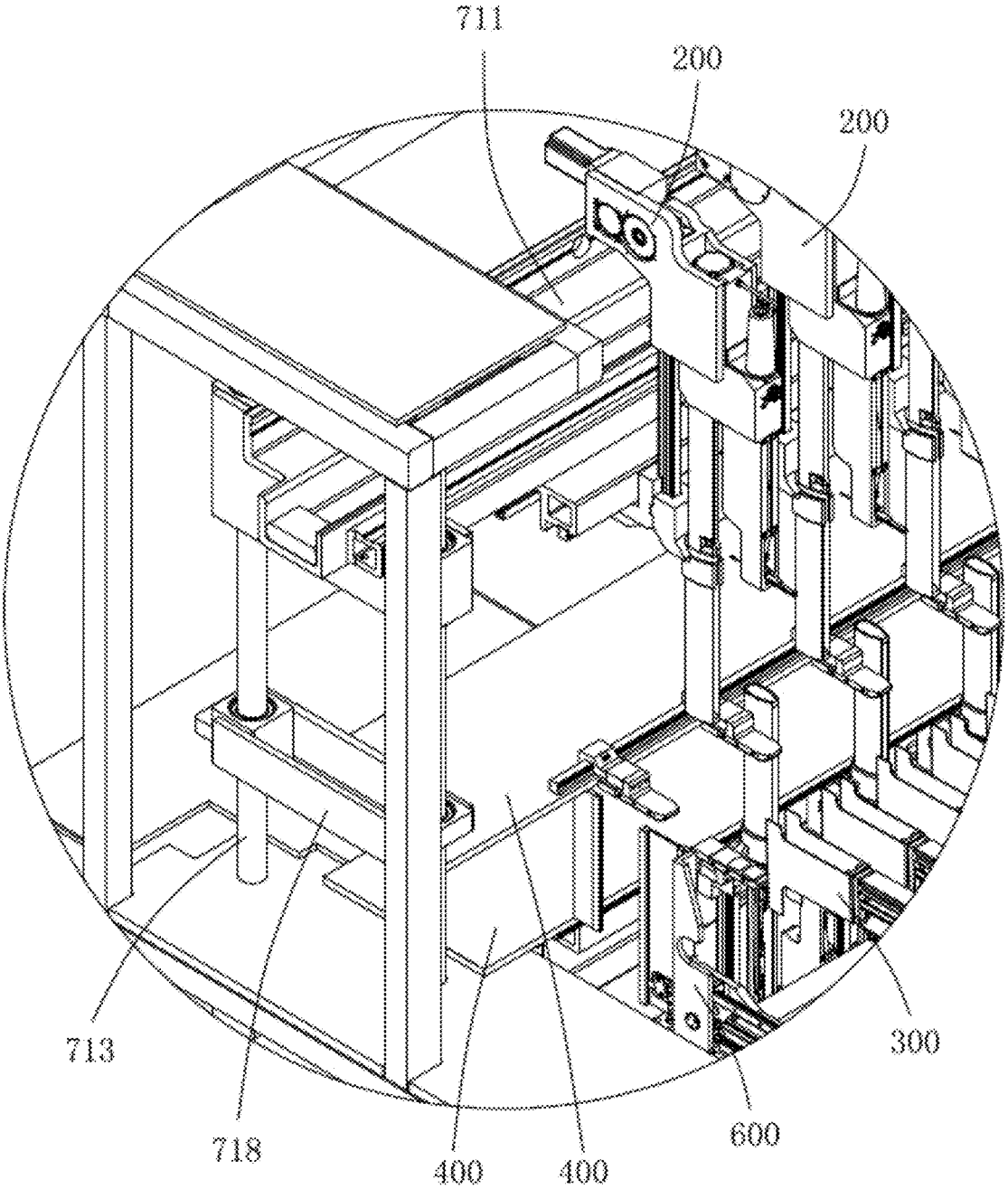
FIG. 11 is a partial enlarged view of area A in FIG. 1.
Figure 12:
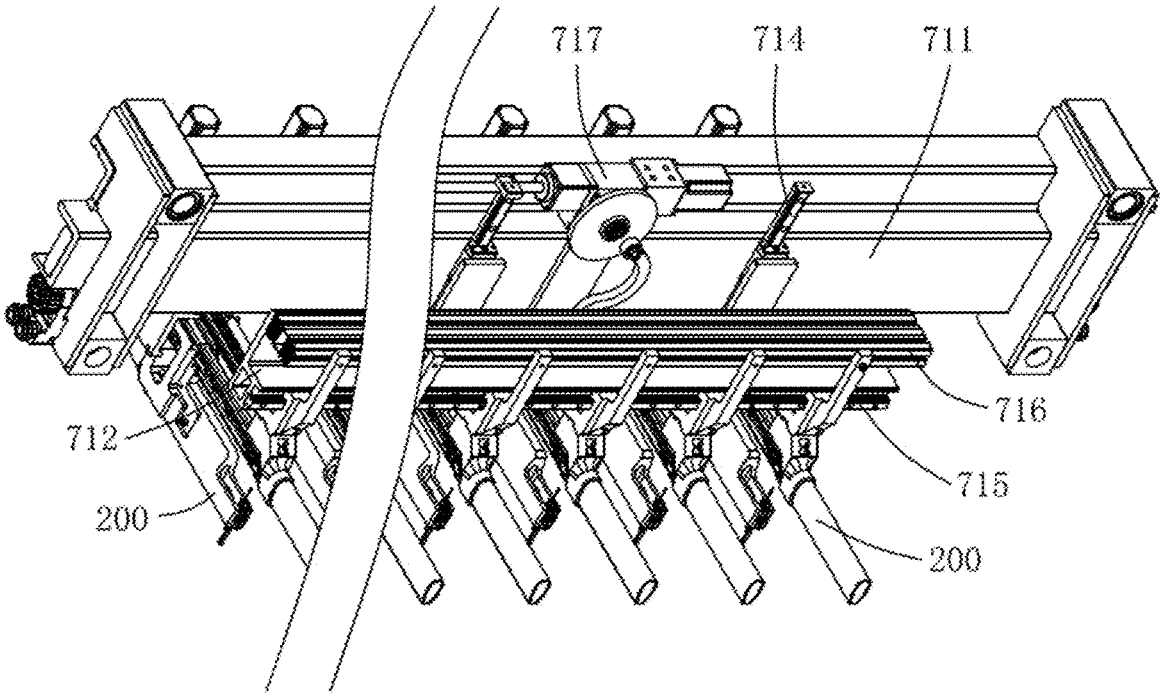
FIG. 12 is a schematic diagram of a partial structure of the installation relationship between the sewing assemblies and the first installation assemblies according to an embodiment of the present disclosure.

Exemplarily, referring to FIGS. 4, 11 and 12, each first installation assembly includes a first installation base 711, a second installation base 712, a first guide member 713 (embodied as a guide post in the figure), and a second guide member 714 (embodied as a guide rail in the figure). The first guide member 713 is installed on a frame and extends along the vertical direction, and the first installation base 711 is movably installed on the first guide member 713. The second guide member 714 is installed on the first installation base 711 and extends along the longitudinal direction, and the second installation base 712 is movably installed on the second guide member 714. Each sewing assembly 200 is installed on the second installation base 712. The first driver (not shown in the figure) is connected to the first installation base 711 to drive the first installation base 711 to move in the vertical direction. The second driver 717 is a rotating motor and constructs a crank slider mechanism through an eccentric wheel, so as to be connected to the second installation base 712 and drive the second installation base 712 to move in the longitudinal direction.

The first driver may be directly connected to the first installation base 711, or may be indirectly connected to the first installation base 711 through belt drive, chain drive, screw drive, linkage drive, etc. Similarly, the second driver 717 may be directly connected to the second installation base 712, or may be indirectly connected to the second installation base 712 through belt drive, chain drive, screw drive, linkage drive, etc. In addition to the guide rail and guide post, the first guide member 713 and the second guide member 714 may also be designed with reference to existing related art, which will not be described again here.

In some embodiments, the spacing between adjacent sewing assemblies 200 is adjustable, so as to match the spring strings 900 of different specifications. Exemplarily, continuing to refer to FIGS. 4 and 12, each first installation assembly includes a third guide member 715 extending in the transverse direction (embodied as a guide rail in the figure), and each sewing assembly 200 is movably installed on the third guide member 715, allowing position adjustment in the transverse direction. The third guide member 715 is installed on the second installation base 712 to realize the installation of each sewing assembly 200 on the first installation assembly.

Each first installation assembly may further include a fixing base 716 formed with a fastening groove extending in the transverse direction. The sewing assemblies 200 are fixedly connected to the fastening grooves through fasteners, thereby locking positions after the transverse adjustment. The fixing bases 716 may use standard profiles as shown in FIG. 12, which helps to reduce processing costs. The fixing bases 716 are installed on the respective second installation bases 712. Adding the fixing bases 716 also helps to improve the structural strength of the second installation bases 712. If the strength permits, the fastening grooves may also be directly provided in the respective second installation bases 712.

The sewing principle of the sewing heads 210 may refer to sewing machines in the related art. Simply speaking, referring to FIG. 5, the needle plate 212 and the base 220 are located on the same side of the needle 211 in the longitudinal direction, and the sewing channel has an opening toward the needle 211 in the longitudinal direction. Each of the sewing positions is pressed against the opening of the respective sewing channel. When the sewing head 210 moves along the sewing channel, the needle plate 212 enters the sewing channel, and the needle 211 is located outside the sewing channel, so that the needle plate 212 and the needle 211 are located on both sides of the sewing position, respectively. The needle 211 carries the suture line to pass through the sewing position, moves toward the needle plate 212, and then returns to the side where it is, so as to sew the sewing position once. The needle 211 reciprocates with the movement of the sewing head 210, so as to complete the sewing process.

Each sewing assembly 200 needs to include a third driver 230, which is used to drive the respective sewing head 210 to move in the vertical direction. The third driver 230 may be directly connected to the sewing head 210, or may also be indirectly connected to the sewing head 210 through belt drive, chain drive, screw drive, linkage drive, etc. For example, referring to FIGS. 4 and 6, the third driver 230 is driven through a gear and rack mechanism, and the third driver 230 is a rotating motor. A gear is connected to the third driver 230, and the corresponding rack is installed on the base 220.

During the vertical sewing process of the sewing heads 210, the cloth pressing assemblies 300 need to continuously and stably cooperate with the bases 220 to press the sewing positions of the spring strings 900, so as to ensure the quality of the sutures. For this reason, the cloth pressing assemblies 300 need to avoid the moving sewing heads 210.

Exemplarily, referring to FIGS. 4 and 6, each of the cloth pressing assemblies 300 includes first pressing plates 310. Two first pressing plates 310 are arranged at an interval in the transverse direction, and an avoidance channel for avoiding the respective sewing head 210 is formed between the first pressing plates 310. Each cloth pressing assembly 300 includes a fourth driver 320, on which each first pressing plate 310 is installed. The fourth driver 320 is used to drive the first pressing plate 310 to move in the longitudinal direction. On the one hand, the avoidance channel serves to avoid the sewing head 210. On the other hand, the cloth pressing assemblies 300 each use two first pressing plates 310 to apply pressure from both sides, achieving better pressing on the sewing positions.

Referring further to FIG. 6, the two first pressing plates 310 may be designed in an integrated manner. Specifically, each of the cloth pressing assemblies 300 has a compression member, and both ends of the compression member are folded toward the same side, thereby forming the two first pressing plates 310. The middle part of the compression member forms a bottom plate 330 that connects the two first pressing plates 310. The bottom plate 330 is installed at an output end of the fourth driver 320 (herein, the cylinder) through fasteners. The integrated design can simplify the installation method, and can also keep the relative positional relationship of the two first pressing plates 310 stable, avoiding repeated debugging and calibration during assembly.

The cloth pressing assemblies 300 are located on the same side of the sewing assemblies 200 as the feeding assembly 100 in the longitudinal direction. Therefore, when the feeding assembly 100 lays the spring strings 900, the cloth pressing assemblies 300 need to perform an avoidance movement to avoid the movement path of the feeding assembly 100. The cloth pressing assemblies 300 can perform avoidance in a moving or rotating way. For example, the cloth pressing assemblies 300 are designed to be able to move in the vertical direction, or the cloth pressing assemblies 300 are designed to be able to rotate around the axis in the transverse direction, etc.

In some embodiments, considering that the cloth pressing assemblies 300 may interfere with the sewing assemblies 200 during vertical avoidance (refer to FIG. 4), the cloth pressing assemblies 300 are designed to implement avoidance through rotating. Specifically, referring to FIGS. 4, 9 and 10, the spring bed mesh sewing device includes a second installation assembly, which includes a fourth installation base 722 and a fifth driver 724. The fourth installation base 722 is rotatably installed on the frame, each cloth pressing assembly 300 is installed on the fourth installation base 722, and the fifth driver 724 is used to drive the fourth installation base 722 and the cloth pressing assemblies 300 thereon to rotate.

When the spacing between adjacent sewing assemblies 200 in the transverse direction is adjustable, the spacing between adjacent cloth pressing assemblies 300 also needs to be adjustable, so that the sewing assemblies 200 can be adapted to spring strings 900 of different specifications. Exemplarily, referring to FIGS. 4 and 9, the second installation assembly includes a fourth guide member 723 (embodied as a guide rail in the figure) extending in the transverse direction, and each cloth pressing assembly 300 is movably installed on the fourth guide member 723. The fourth guide member 723 is further installed on the fourth installation base 722 to realize the installation of each cloth pressing assembly 300.

The feeding assembly 100 conveys the spring strings 900 through the conveying member 110. Exemplarily, referring to FIG. 3, the conveying member 110 includes two ratchets arranged oppositely in the transverse direction. The shape of the ratchets matches the shape of the bagged springs, and the bagged springs are sent out sequentially as the ratchets rotate, thereby effectively controlling the conveying speed. In addition to the ratchets, the conveying member 110 may also adopt structures with a conveying capability such as rollers and conveying belts. According to the specific design of the conveying member 110, the conveying member 110 may be arranged on one side or both sides of the spring string 900. The conveying member 110 may be arranged in the transverse or vertical direction.

The feeding assembly 100 is further formed with a conveying channel, and the conveying member 110 is located at an outlet of the conveying channel. The conveying channel limits the feeding path of the spring strings 900 to avoid interference between the spring strings 900 and other structures of the spring bed mesh sewing device. For example, in FIG. 3, the conveying channel limits the spring strings 900 in the transverse and vertical direction, which, on the one hand, prevents the spring strings 900 from swinging in the transverse direction when the feeding assembly 100 moves in the transverse direction, and on the other hand, prevents the spring strings 900 from being curved and dropped in the vertical direction under the influence of its own weight. In order to make the conveying of the spring strings 900 smoother, rolling elements 120 (such as the rollers arranged in rows in FIG. 3) may be arranged on the inner wall of the conveying channel. The rolling elements 120 are used to reduce the conveying resistance of the spring strings 900.

Since there is a time difference between the feeding assembly 100 laying the spring strings 900, and the cloth pressing assemblies 300 pressing the spring strings 900 and the sewing assemblies 200 sewing the spring strings 900, it is necessary to limit the laid spring strings 900 in advance to prevent that the positions of the spring strings 900 change or even the spring strings 900 fall under their own weights.

To this end, in some embodiments, the spring bed mesh sewing device includes two limit assemblies 400 arranged at an interval in the vertical direction, so as to form a material receiving channel for limiting the spring strings 900. The bases 220 extend in the vertical direction and across the material receiving channel, and the feeding assembly 100 lays the spring strings 900 to the bases 220 located in the material receiving channel. Referring to FIG. 4, this means that compared to the bases 220 waiting for the spring strings 900 at the sewing stations, the entrance of the material receiving channel is closer to the feeding assembly 100 in the longitudinal direction, and the bases 220 and the two limit assemblies 400 limit the spring strings 900 from three directions, respectively, thereby preventing the positions of the spring strings 900 from changing. In order to improve the limiting effect, the limit assemblies 400 may be further provided with magnets for attracting and positioning the spring strings 900.

The size of the material receiving channel needs to correspond to the size of the spring strings 900. In order to match the spring strings 900 of different specifications, the spacing between the two limit assemblies 400 in the vertical direction can be adjusted. Specifically, one limit assembly 400 may be stationary in the vertical direction, and the other limit assembly 400 may be movable in the vertical direction, or both limit assemblies 400 may be movable in the vertical direction. Exemplarily, referring to FIGS. 11 and 13, each first installation assembly further includes a fifth installation base 718. The fifth installation base 718 is installed on the first guide member 713, and one of the limit assemblies 400 located above is installed on the fifth installation base 718, so that the limit assembly 400 can move in the vertical direction, thereby adjusting the size of the material receiving channel in the vertical direction. The sewing assemblies 200 and the limit assemblies 400 share the first installation assemblies for installation, which helps to simplify the structural design of the spring bed mesh sewing device, reduce production costs, and facilitate maintenance.

Figure 13:
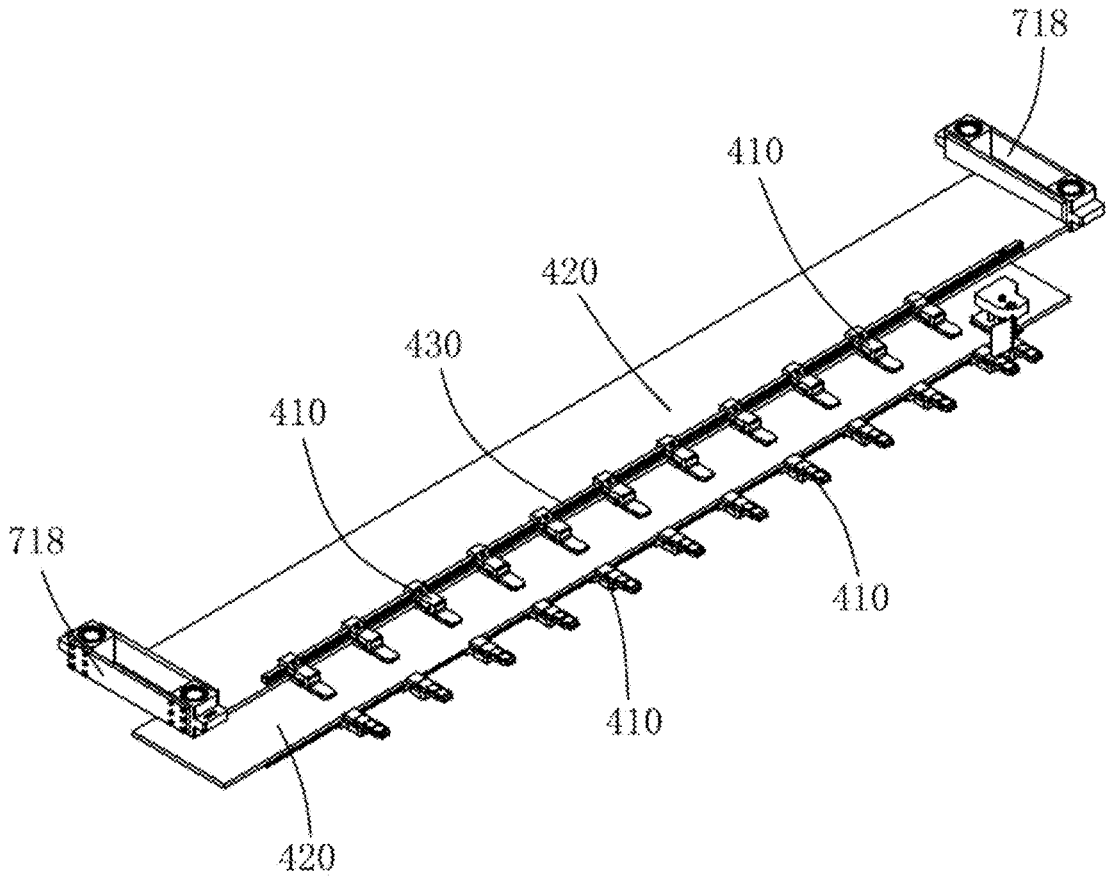
FIG. 13 is a schematic diagram of a partial structure of limit assemblies according to an embodiment of the present disclosure.

The limit assemblies 400 need to avoid the movement paths of the sewing assemblies 200. Therefore, each of the limit assemblies 400 includes limit bars 410. The limit bars 410 of the same group are arranged at intervals in the transverse direction, and the limit bars 410 are staggered from the sewing assemblies 200 in the transverse direction, so as to allow the sewing assemblies 200 to pass between the limit bars 410. As shown in FIG. 13, the limit bars 410 may be provided with grooves, and the magnets can be placed in the grooves.

Referring to FIGS. 4 and 13, each limit assembly 400 may further include a connecting plate 420. The limit bars 410 are installed on the connecting plate 420. The connecting plate 420 is located on the sides of the limit bars 410 away from the feeding assembly 100, and allows the material receiving channel to extend, so as to guide the sewn spring strings 900 to be discharged. In order to adapt to changes in the spacing between the sewing assemblies 200, each limit assembly 400 may further include a fifth guide member 430 (embodied as a guide rail in the figure) extending in the transverse direction. The limit bars 410 are movably installed on the fifth guide member 430, so as to adjust the spacing between the limit bars 410 in the transverse direction. The fifth guide member 430 is installed on the connecting plate 420 to realize the installation of the limit bars 410.

In some embodiments, the spring bed mesh sewing device further includes a receiving assembly, which is located on the side of the limit assemblies 400 away from the feeding assembly 100. The receiving assembly is docked with the limit assemblies 400 to receive the spring bed mesh formed after sewing. Exemplarily, referring to FIG. 4, the receiving assembly may include a receiving table 510, which is used to receive the spring bed mesh. Alternatively, the receiving assembly may further include a conveying line that sends out the spring bed mesh.

The spring string 900 may be provided to the spring bed mesh sewing device in a continuous state, thereby eliminating the step of cutting the spring string 900 to a designed length in advance. In this case, after the feeding of the feeding assembly 100 is completed, the spring bed mesh sewing device needs to cut the continuous spring string 900. To this end, the spring bed mesh sewing device includes a cutting assembly 600 for cutting the spring string 900.

Figure 14:
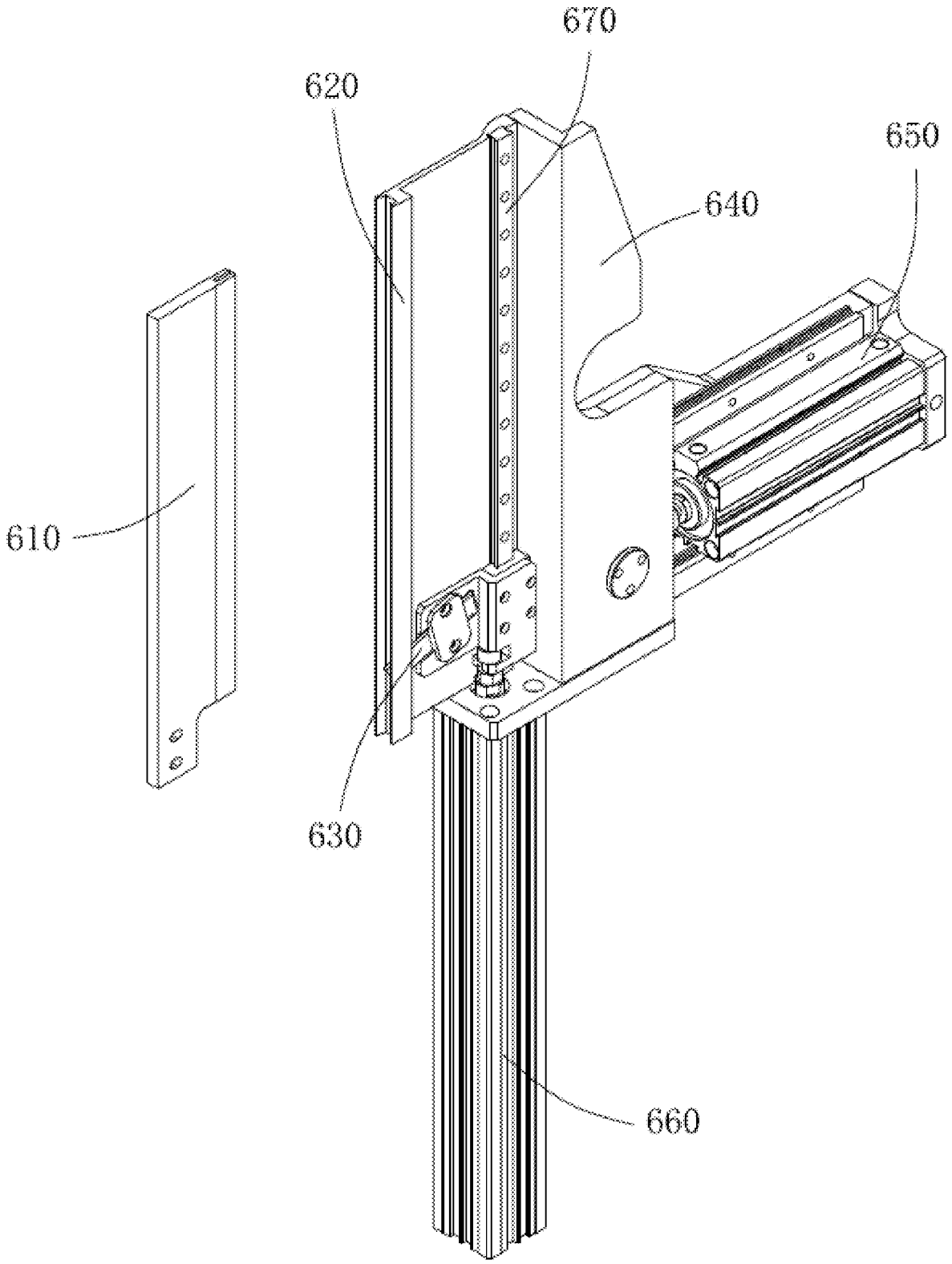
FIG. 14 is a schematic diagram of a partial structure of cutting assemblies according to an embodiment of the present disclosure.

Exemplarily, referring to FIGS. 11 and 14, the cutting assembly 600 is located on one or both sides of the sewing assemblies 200 in the transverse direction. The cutting assembly 600 includes a second pressing plate 610, a third pressing plate 620, and a cutter 630. The second pressing plate 610 and the third pressing plate 620 are arranged oppositely in the longitudinal direction, and can move toward each other to compress the spring string 900. The cutter 630 can move in the vertical direction to cut the spring string 900.

Further, referring to FIG. 14, the cutting assembly 600 includes a fifth installation base 640, a sixth driver 650, and a seventh driver 660. The cutter 630, the seventh driver 660 and the third pressing plate 620 are installed on the fifth installation base 640. The sixth driver 650 can drive the fifth installation base 640 to move in the longitudinal direction toward the second pressing plate 610. The cutter 630 is installed through the sixth guide member 670 (embodied as guide rail in the figure) extending in the vertical direction. The seventh driver 660 can drive the cutter 630 to move in the vertical direction. The third pressing plate 620 is formed with a cutting groove extending in the vertical direction. The cutter 630 extend from the cutting groove to between the second pressing plate 610 and the third pressing plate 620, so as to cut the spring string 900 compressed by the second pressing plate 610 and the third pressing plate 620.

It can be understood that when the spring strings 900 in the rows of the spring bed mesh are separated from each other, the feeding assembly 100 lays the spring string 900 in each row and the cutting assembly 600 performs cutting once. When the spring strings 900 in various rows in the spring bed mesh are connected to each other, the cutting assembly 600 only cuts the spring string 900 in the last row when the spring bed mesh is sewn, so that the completed spring bed mesh is separated from the remaining spring strings 900.

In the description of this specification, description with reference to the terms such as "one embodiment", "some embodiments", "illustrative embodiments", "examples", "specific examples", or "some examples" implies that specific characteristics, structures, materials or features described in conjunction with the embodiments or examples are included in at least one embodiment or example of the present disclosure. In this specification, the schematic expression of the above terms does not necessarily refer to the same embodiment or example. Moreover, the specific characteristics, structures, materials or features described can be combined in any one or more embodiments or examples in a suitable manner.

In some alternative embodiments, the functions/operations noted in the block diagrams may occur out of the order noted in the operational illustrations. For example, two blocks shown in succession may in fact be executed substantially concurrently or the blocks may sometimes be executed in the reverse order, depending on the functionality/operations involved. Furthermore, the embodiments presented and described in the flowcharts of the present disclosure are provided by way of example for the purpose of providing a more comprehensive understanding of the technology. The disclosed methods are not limited to the operations and logical flows presented herein. Alternative embodiments are contemplated in which the order of various operations is changed and in which sub-operations described as part of a larger operation are performed independently.

Although the embodiments of the present disclosure have been shown and described, a person of ordinary skill in the art may understand that various changes, modifications, substitutions and variations can also be made to these embodiments without departing from the principle and purpose of the present disclosure, and the scope of the present disclosure is defined by the claims and their equivalents.

What is claimed is:

1. A spring bed mesh sewing device, comprising:

a feeding assembly, wherein the feeding assembly is movable in a transverse direction, wherein the transverse direction is a laying direction of spring strings, so as to lay spring strings along the transverse direction, connecting parts of the spring strings in two adjacent rows are defined as sewing positions that comprise first sewing positions and second sewing positions, each of the spring strings to be sewn in even rows is sewn on a respective previous spring string through the first sewing positions, and each of the spring strings to be sewn in odd rows is sewn on a respective previous spring string through the second sewing positions;

a plurality of sewing assemblies arranged at intervals in the transverse direction and aligned with the sewing positions in the transverse direction, wherein the sewing assemblies are movable in a vertical direction so as to be pulled out from the spring strings and switched to the spring strings in a next row, each of the sewing assemblies comprises a sewing head and a base, the base is formed with a sewing channel extending in the vertical direction, the sewing head is installed on the base and comprises a needle and a needle plate that are arranged oppositely in a longitudinal direction, and the sewing head is movable along the sewing channel to sew the spring strings in two adjacent rows; and a plurality of cloth pressing assemblies arranged at intervals in the transverse direction, wherein the cloth pressing assemblies are aligned with the sewing assemblies in the longitudinal direction and are configured to press the sewing positions to be sewn on the base, so as to cooperate with the sewing head for sewing.

2. The spring bed mesh sewing device according to claim 1, wherein the sewing assemblies are movable in the longitudinal direction, so as to push the sewn spring strings to move downstream.

3. The spring bed mesh sewing device according to claim 1, wherein the sewing assemblies are movable in the transverse direction, so as to be aligned with the first sewing positions or the second sewing positions in the transverse direction, respectively.

4. The spring bed mesh sewing device according to claim 1, wherein the plurality of sewing assemblies are divided into two groups, the sewing assemblies of the same group are arranged at intervals in the transverse direction, the sewing assemblies of different groups are interlaced with each other in the transverse direction, the two groups of sewing assemblies are aligned with the first sewing positions and the second sewing positions in the transverse direction respectively, and the sewing assemblies are movable in the longitudinal direction, so that the two groups of sewing assemblies alternately push the spring strings and perform sewing actions.

5. The spring bed mesh sewing device according to claim 4, further comprising two first installation assemblies, wherein the two groups of sewing assemblies are installed on the two first installation assemblies respectively, and are arranged on opposite sides of the spring strings in the vertical direction respectively.

6. The spring bed mesh sewing device according to claim 5, wherein each of the first installation assemblies comprises a first installation base, a second installation base, a first guide member, and a second guide member, the first guide member is installed on a frame and extends along the vertical direction, the first installation base is movably installed on the first guide member, the second guide member is installed on the first installation base and extends along the longitudinal direction, and the second installation base is movably installed on the second guide member.

7. The spring bed mesh sewing device according to claim 6, wherein a spacing between adjacent sewing assemblies is adjustable, so as to match the spring strings of different specifications, each of the first installation assemblies comprises a third guide member extending in the transverse direction, the third guide member is installed on the second installation base, and each of the sewing assemblies is movably installed on the third guide member.

8. The spring bed mesh sewing device according to claim 1, wherein each of the cloth pressing assemblies comprises two first pressing plates arranged at an interval in the transverse direction, an avoidance channel for avoiding the sewing head is formed between the first pressing plates, each of the cloth pressing assemblies comprises a fourth driver, the first pressing plates are installed on the fourth driver, and the fourth driver is configured to drive the first pressing plates to move in the longitudinal direction.

9. The spring bed mesh sewing device according to claim 8, wherein the cloth pressing assemblies are movable in the vertical direction, or the cloth pressing assemblies is rotatable around an axis along the transverse direction, so as to avoid a movement path of the feeding assembly; the spring bed mesh sewing device comprises a second installation assembly comprising a fourth installation base and a fifth driver, the fourth installation base is rotatably installed on the frame, the cloth pressing assemblies are installed on the fourth installation base, and the fifth driver is configured to drive the fourth installation base and the cloth pressing assemblies to rotate.

10. The spring bed mesh sewing device according to claim 9, wherein a spacing between adjacent cloth pressing assemblies is adjustable, so as to match the spring strings of different specifications, the second installation assembly comprises a fourth guide member extending in the transverse direction, and the cloth pressing assemblies are movably installed on the fourth guide member.

11. The spring bed mesh sewing device according to claim 1, further comprising two limit assemblies arranged at an interval in the vertical direction, so as to form a material receiving channel for limiting the spring strings, wherein the base extends in the vertical direction and across the material receiving channel, and the feeding assembly lays the spring strings on the base located in the material receiving channel.

12. The spring bed mesh sewing device according to claim 11, wherein each of the limit assemblies comprises limit bars, the limit bars of the same group are arranged at intervals in the transverse direction, the limit bars are staggered from the sewing assemblies in the transverse direction, so as to allow the sewing assemblies to pass between the limit bars, the limit bars are provided with magnets for attracting and positioning the spring strings, each of the limit assemblies comprises a fifth guide member extending in the transverse direction, and each of the limit bars is movably installed on the respective fifth guide member, so as to adjust an spacing between the limit bars in the transverse direction.

13. The spring bed mesh sewing device according to claim 11, further comprising a receiving assembly, wherein the receiving assembly is located on a side of the limit assemblies away from the feeding assembly, and the receiving assembly comprises a receiving platform for receiving a spring bed mesh.

14. The spring bed mesh sewing device according to claim 1, further comprising a cutting assembly, wherein the cutting assembly is located on one side or both sides of the sewing assemblies in the transverse direction, the cutting assembly comprises a second pressing plate, a third pressing plate and a cutter, the second pressing plate and the third pressing plate are arranged oppositely in the longitudinal direction and are movable toward each other to compress the spring strings, and the cutter is movable in the vertical direction to cut the spring strings.

15. The spring bed mesh sewing device according to claim 1, wherein the feeding assembly comprises a conveying member, and the conveying member comprises at least one of ratchets, rollers and a conveying belt, and is configured to convey the spring strings.

16. The spring bed mesh sewing device according to claim 15, wherein the feeding assembly is formed with a conveying channel, the conveying member is located at an outlet of the conveying channel and comprises two ratchets arranged oppositely in the transverse direction, rolling elements are arranged on an inner wall of the conveying channel, and the rolling elements are configured to reduce a conveying resistance of the spring strings.

17. A spring bed mesh sewing method, using the spring bed mesh sewing device according to claim 1, and comprising:

S100: moving the sewing assemblies to align with the first sewing positions in the transverse direction;

S200: moving the feeding assembly along the transverse direction to lay the spring string in a first row;

S300: moving the feeding assembly along the transverse direction to lay the spring string in an even row on the spring string in an odd row;

S400: pressing by the cloth pressing assemblies the first sewing positions of the spring string in the even row and the spring string in the odd row on the bases, and moving the sewing heads along the vertical direction to sew the first sewing positions;

S500: pulling the sewing assemblies out from the spring strings, and releasing compression by the cloth pressing assemblies;

S600: moving the sewing assemblies to align with the second sewing positions in the transverse direction;

S700: moving the feeding assembly along the transverse direction to lay the spring string in a further odd row on the spring string in the even row;

S800: pressing by the cloth pressing assemblies the second sewing positions of the spring string in the even row and the spring string in the further odd row on the bases, and moving the sewing heads along the vertical direction to sew the second sewing positions;

S900: pulling the sewing assemblies out from the spring strings, and releasing compression by the cloth pressing assemblies;

S1000: moving the sewing assemblies to align with the first sewing positions in the transverse direction; and repeating S300 to S1000 until the spring strings are sewn into a spring bed mesh of a predetermined size.

18. The spring bed mesh sewing method according to claim 17, wherein in S1000, the sewing assemblies move along the transverse direction and switch to align with the first sewing positions in the transverse direction, and in S600, the sewing assemblies move along the transverse direction and switch to align with the second sewing positions in the transverse direction.

19. A spring bed mesh sewing method, using the spring bed mesh sewing device according to claim 4, and comprising:

S100: moving a first group of sewing assemblies to be in sewing stations;

S200: moving the feeding assembly along the transverse direction to lay the spring string in a first row;

S300: moving a second group of sewing assemblies to a side of the spring strings in an odd row close to the feeding assembly, and moving the second group of the sewing assemblies along the longitudinal direction to push the spring string in the odd row to the sewing stations;

S400: moving the feeding assembly along the transverse direction to lay the spring string in an even row on the spring string in the odd row;

S500: pressing by the cloth pressing assemblies the first sewing positions of the spring string in the even row and the spring string in the odd row on the bases of the first group of sewing assemblies, and moving the sewing heads of the first group of sewing assemblies along the vertical direction to sew the first sewing positions;

S600: pulling the first group of sewing assemblies out from the spring strings, and releasing compression by the cloth pressing assemblies;

S700: moving the first group of sewing assemblies to a side of the spring string in the even row close to the feeding assembly, and move the first group of sewing assemblies along the longitudinal direction to push the spring string in the even row to the sewing stations;

S800: moving the feeding assembly along the transverse direction to lay the spring string in a further odd row on the spring string in the even row;

S900: pressing by the cloth pressing assemblies the second sewing positions of the spring string in the even row and the spring string in the further odd row on the bases of the second group of sewing assemblies, and moving the sewing heads of the second group of sewing assemblies along the vertical direction to sew the second sewing positions;

S1000: pulling the second group of sewing assemblies out from the spring strings, and releasing compression by the cloth pressing assemblies; and repeating S300 to S1000 until the spring strings are sewn into a spring bed mesh of a predetermined size.

* * * * *